US011725309B2

(12) United States Patent
Young et al.

(10) Patent No.: US 11,725,309 B2
(45) Date of Patent: Aug. 15, 2023

(54) COFORMING PROCESSES AND FORMING BOXES USED THEREIN

(71) Applicant: The Procter & Gamble Company, Cincinnati, OH (US)

(72) Inventors: Christopher Michael Young, Loveland, OH (US); Fei Wang, Mason, OH (US); Steven Lee Barnholtz, West Chester, OH (US); Hasan Eroglu, Liberty Township, OH (US); Edwin Arthur Stewart, Cincinnati, OH (US); John Ferney McKibben, West Chester, OH (US); Gustav Andre Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 763 days.

(21) Appl. No.: 14/970,586

(22) Filed: Dec. 16, 2015

(65) Prior Publication Data

US 2016/0355950 A1 Dec. 8, 2016

Related U.S. Application Data

(60) Provisional application No. 62/170,179, filed on Jun. 3, 2015.

(51) Int. Cl.

| | |
|---|---|
| ***D04H 1/732*** | (2012.01) |
| ***D04H 1/56*** | (2006.01) |
| ***D01D 5/098*** | (2006.01) |
| ***D01F 11/00*** | (2006.01) |
| ***D01D 5/00*** | (2006.01) |

(52) U.S. Cl.
CPC ..... *D01F 11/00* (2013.01); *D01D 5/00* (2013.01); *D04H 1/565* (2013.01); *D04H 1/732* (2013.01); *D01D 5/0985* (2013.01)

(58) Field of Classification Search
CPC ..... D01D 5/0985; D01F 11/00; D04H 1/565; D04H 1/732; D04H 3/16; D04H 3/163; D04H 3/166
See application file for complete search history.

(56) References Cited

U.S. PATENT DOCUMENTS

| | | | | |
|---|---|---|---|---|
| 3,971,373 | A * | 7/1976 | Braun | A62B 23/025 128/206.19 |
| 4,902,559 | A | 2/1990 | Eschwey et al. | |
| 5,227,107 | A * | 7/1993 | Dickenson | A61F 13/15626 264/113 |
| 5,569,489 | A | 10/1996 | Kasmark, Jr. | |
| 5,807,795 | A | 9/1998 | Lau et al. | |

(Continued)

OTHER PUBLICATIONS

U.S. Appl. No. 14/970,583, filed Dec. 16, 2015.

(Continued)

*Primary Examiner* — Xiao S Zhao
*Assistant Examiner* — Joseph S Leyson
(74) *Attorney, Agent, or Firm* — C. Brant Cook

(57) ABSTRACT

Coforming processes for commingling two or more separate materials, for example solid additives, for example fibers and/or particulates, and filaments, and equipment; namely, forming boxes, useful in such coforming processes and more particularly to coforming processes for commingling filaments with one or more fibers, such as pulp fibers, and forming boxes useful therein are provided.

15 Claims, 15 Drawing Sheets

(56) References Cited

U.S. PATENT DOCUMENTS

| | | | | |
|---|---|---|---|---|
| 6,364,647 | B1 * | 4/2002 | Sanborn | D01D 4/025 425/192 S |
| 6,379,136 | B1 | 4/2002 | Najour et al. | |
| 7,014,441 | B2 | 3/2006 | Haynes et al. | |
| 2003/0111774 | A1 | 6/2003 | Kellenberger et al. | |
| 2003/0114066 | A1 | 6/2003 | Clark et al. | |
| 2005/0003156 | A1 | 1/2005 | Fereshtehkhou et al. | |
| 2005/0087287 | A1 | 4/2005 | Lennon et al. | |
| 2010/0048072 | A1 | 2/2010 | Kauschke et al. | |
| 2011/0104419 | A1 | 5/2011 | Bamholtz et al. | |
| 2011/0152808 | A1 | 6/2011 | Jackson | |
| 2012/0227203 | A1 | 9/2012 | Ouellette et al. | |

OTHER PUBLICATIONS

U.S. Appl. No. 14/970,581, filed Dec. 16, 2015.
PCT International Search Report dated Mar. 18, 2016—5 pages.
International Search Report dated Apr. 4, 2016—6 pages.
PCT International Search Report dated Mar. 31, 2016—6 pages.
All Office Actions in U.S. Appl. No. 14/970,581 and U.S. Appl. No. 14/970,581.

* cited by examiner

COFORMING PROCESSES AND FORMING BOXES USED THEREIN

FIELD OF THE INVENTION

The present invention relates to coforming processes for commingling two or more materials, for example solid additives, for example fibers and/or particulates, and filaments, and equipment; namely, forming boxes, useful in such coforming processes and more particularly to coforming processes for commingling filaments with one or more fibers, such as pulp fibers, and forming boxes useful therein.

BACKGROUND OF THE INVENTION

Forming boxes have been used in the past to facilitate the commingling ("coforming") of two or more materials such as filaments and fibers during a fibrous structure making process. However, the known forming boxes were designed to have one material, for example pulp fibers, being injected into another material, for example filaments, in a perpendicular fashion (90° to one another) as shown in Prior Art FIG. 1. The prior art forming box (coform box) 10 shown in FIG. 1 has a first material inlet 12 and a second material inlet 14. Filaments 16 from a filament source 18, such as a die, enter the coform box 10 through the first material inlet 12. Pulp fibers 20 from a fiber source 22, such as a fiber spreader, in fluid communication with a hammermill 24 enter the coform box 10 through the second material inlet 14. The pulp fibers 20 contact the filaments 16 inside the coform box 10 in a perpendicular fashion, in other words at an angle β of 90° from one side ("single-sided injection"). One problem with these known forming boxes used in coforming processes is that the 90° angle at which the two materials (filaments and pulp fibers) impact one another creates instability in the air jet transporting the filaments 16 because the air jet transporting the pulp fibers 20 feeds more air into the air jet transporting the filaments 16 than it wants to entrain thus resulting in instability in the air jet transporting the filaments 16, which ultimately leads to poor formation of the fibrous structure 26 being collected on the belt 28. In an arrangement in which the angle β is close to 90°, any CD variation in velocity of the second material, such as pulp fibers 20, entering the coform box through the second material inlet 14 will have a large effect on the pulp fibers 20 and the subsequent CD weight distribution of the pulp fibers 20 in the resulting fibrous structure 26.

In addition to the known coforming processes that utilize the known forming boxes, there are known coforming processes that do not utilize a forming box as shown in Prior Art FIGS. 2 and 3. In one example as shown in Prior Art FIG. 2, a known coforming process commingles filaments 16 from a filament source 18, such as a die, with pulp fibers 20, from a fiber source 22, such as a picker roll, by injecting a single stream of the pulp fibers 20 into the intersection of two streams of filaments 16 in an open, non-enclosed, non-controlled environment (i.e., not within a forming box). The problems with this coforming process are since this geometry is not constrained within a forming box, the air flows exhibited will be constrained by the various jets' ability to naturally entrain air through physics. Any increase in airflow from the pulp fibers 20 beyond what can be entrained by the filaments 16 will result in a local high pressure zone at the intersection of the respective jets, causing hygiene issues in the production of the substrate.

In addition, since the lack of the forming box limits the amount of air that can be used, it also limits the speed with which heat can be taken out of the various streams. The current invention discloses the addition of air at greater than the natural ability of the jet to entrain, as well as the introduction of liquid water, both of which result in more rapid removal of heat from the jet.

Prior Art FIG. 3 shows an example of another known coforming process that commingles filaments 16 with pulp fibers 20 by injecting a single stream of pulp fibers 20, from a fiber source 22, such as a picker roll, into one side ("single-sided injection") of a single stream of filaments 16 from a filament source 18, such as a die, at a angle of 90° in an open, non-enclosed, non-controlled environment (i.e., not within a forming box). The problems with this coforming process are 1) it relies more heavily on the natural entrainment from room air to quench the polymer forming the filaments, for example polypropylene; 2) the 90° introduction of pulp to the melt results in jet instability and CD control issues, especially at higher JARS; and 3) heat transfer issues associated with the natural entrainment limitation and lack of liquid water.

As seen above, a problem with existing coforming processes is that the formation of a fibrous structure made from the coforming process, even when a known forming box is used in the process, needs improved due to multiple (and sometimes contradictory) requirements on what must occur in the coform box in order to meet consumer desires. These requirements include, but are not limited to:

1. Maximizing jet stability at all mass ratios of the streams (JAR).
2. Minimizing zones of stalls and/or separated flow within the box, which can result in fibrous structure imperfections and formation issues.
3. Maximizing heat transfer in and/or out of jets while minimizing mass flow rates in quenching streams.

Accordingly, there is a need for a coforming process and/or a forming box used in a coforming process that overcomes the negatives associated with the known coforming processes and/or known forming boxes used in coforming processes.

SUMMARY OF THE INVENTION

The present invention fulfills the need described above by providing a coforming process and/or a forming box that commingles two or more separate materials at a non-90° angle, for example at an angle of less than 90°.

One solution to the problem identified above with respect to known coforming processes and known forming boxes is to increase the stability of the coforming process by utilizing a forming box within which two or more separate materials, such as filaments and pulp fibers, are commingled in a non-perpendicular fashion, for example in a non-90° angle, such as an angle of less than 90° and/or less than 85° and/or less than 75° and/or less than 45° and/or less than 30° and/or to about 0° and/or to about 10° and/or to about 25°.

Angling the introduction of two or more separate materials (solid additives, liquid, continuous, or atomized) through two or more material inlets together at an angle of less than 90° mitigates this effect, especially at higher momentum ratios between the materials (M×V). Another problem that is corrected by this design is the minimization of separated or stalled flow within the forming box (coform box). This results in more even weight distribution and improved sheet formation.

The present invention has unexpectedly addressed one or more of the multiple (and sometimes contradictory) requirements identified above that must occur in the forming box (coform box) in order to meet consumer desires; namely, 1. Maximizing jet stability at all mass ratios of the streams (JAR).

2. Minimizing zones of stalls and/or separated flow within the box, which can result in fibrous structure imperfections and formation issues.

3. Maximizing heat transfer in and/or out of jets while minimizing mass flow rates in quenching streams.

The coforming processes and/or forming boxes (coform boxes) of the present invention have solved these problems as follows. With respect to 1 above, one skilled in the art would realize that, if one or both of $\theta_1$ and $\theta_2$ were 90° in FIGS. 4A and 4B, an unstable and/or metastable system would result. As a main objective of the coform box is to relieve the operator of the mass flow constraint of natural entrainment of the process stream, this is especially true as mass flow rates of stream A exceeds the natural ability of the center jet to entrain. In addition, if there are any imperfections in the CD flow profile of stream A, the closer that either the momentum ratio between stream A and center jet (mass× velocity) and/or that one or both of $\theta_1$ and $\theta_2$ were equal to 90°, the more likely that imperfection is to carry into the final sheet. One way this can manifest is through a light CD stripe in the fibrous structure as it forms on the collection device 56.

With respect to 2 above, proper design of the coform box according to the present invention will allow for the minimization of stalls and/or zones of separated flow, which are particularly problematic in particle laden flow. Again referring to FIG. 4B, minimizing Ls reduces the volume of upward flow associated with the center section of the coform box. In addition, minimizing the ratio of Lc/Ls will reduce the volume of separated flow subsequent to the introduction of streams and just prior to deposition of the material contained in the coform box upon the formaminous surface. In addition, when viewed in cross section, as in FIGS. 4A and 4B, the walls of the coform box should be designed in accordance with aerodynamic principles. Radiuses between different surfaces should be maximized. In the event that the sidewalls in the chutes are divergent and creating a diffuser, it should be designed so that the flow does not separate from one or both walls. Additionally, the coform box should be designed such that the length of Lc is appropriate to the ratio of mass flow rates and length of dimension Lp, such that a flow separation does not occur in the lower box while also not overly constricting the flow exiting the box, which would cause needlessly high static pressures in the system and effect other components in aerodynamic communication with the coform box.

Finally, with respect to 3 above, coform boxes to date have not been intentionally designed to maximize the heat transfer (either into or out of a jet), while at the same time minimizing the amount of mass used in that heat transfer and maximizing the stability of the jet undergoing the transfer. As shown in FIGS. 4A and 4B, the coform box of the present invention addresses this dichotomy by increasing heat transfer and jet instability at a constant mass flow rate and velocity of stream A as $\theta_1$ and/or $\theta_2$ goes to 90°, increasing heat transfer and jet instability at a constant mass flow rate and angle as the velocity of stream A increases (by decreasing dimension Lp).

In addition, improved heat removal from the coform box of the present invention can be achieved by the introduction of liquid water into the coform box, utilizing the sensible and latent heat of a liquid to remove heat extremely rapidly from the jet. In addition to the expeditious removal of heat, the addition of the liquid to the coform box could impart additional functionality to the substrate either through the addition of a dissolved solid which could precipitate upon liquid evaporation, or through the addition of a functional liquid.

In one example of the present invention, a forming box (coform box) comprising one or more filament inlets, for example polymer filament inlets, and one or more solid additive inlets, wherein at least one of the filament inlets is in fluid communication with a filament source for example a polymer filament source, such as a die, and at least one of the solid additive inlets is in fluid communication with an additive source, for example a solid additive source, such that during operation of the forming box one or more filaments enter the forming box through the at least one filament inlet and one or more solid additives enter the forming box through the at least one solid additive inlet such that the one or more filaments and the one or more solid additives contact each other at a non-90° angle, for example at an angle of less than 90°, is provided.

In another example of the present invention, a forming box (coform box) comprising one or more filament inlets and one or more additive inlets such that at least one of the one or more filament inlets is at an angle of less than 90° to at least one of the additive inlets, is provided.

In another example of the present invention, a forming box comprising one or more filament inlets and one or more solid additive inlets wherein at least one of the one or more filament inlets and at least one of the one or more solid additive inlets are positioned in the forming box at a non-90° angle, for example at an angle of less than 90°, relative one another, is provided.

In still another example of the present invention, a forming box comprising one or more filament inlets and one or more solid additive inlets wherein at least one of the one or more filament inlets and at least one of the one or more solid additive inlets are positioned in the forming box such that filaments entering the forming box through at least one of the filament inlets and solid additives entering the forming box through at least one of the solid additive inlets contact each other inside the forming box at a non-90° angle, for example at an angle of less than 90°, relative to one another, is provided.

In even still another example of the present invention, a forming box comprising one or more filament inlets and one or more solid additive inlets such that filaments entering the forming box through at least one of the filament inlets and solid additives entering the forming box through at least one of the solid additive inlets contact each other at a non-90° angle, for example at an angle of less than 90°, relative to one another, is provided.

In yet another example of the present invention, a forming box comprising one or more filament inlets and two or more solid additive inlets such that filaments entering the forming box through at least one of the filament inlets and solid additives entering the forming box through at least two of the solid additive inlets contact each inside the forming box, is provided.

In still yet another example of the present invention, a forming box comprising two or more filament inlets and two or more solid additive inlets such that filaments entering the forming box through at least one of the filament inlets and solid additives entering the forming box through at least one of the solid additive inlets contact each other inside the forming box, is provided.

In yet another example of the present invention, a coforming process comprising the steps of:

a. providing a forming box comprising one or more filament inlets and one or more solid additive inlets; and b. introducing one or more filaments into the forming box through at least one of the one or more filament inlets and introducing one or more solid additives into the forming box through at least one of the one or more solid additive inlets such that the one or more filaments contact the one or more solid additives inside the forming box at a non-90° angle, for example at an angle of less than 90°, relative to one another, is provided.

In yet another example of the present invention, a coforming process comprising the steps of:

a. providing a forming box comprising one or more filament inlets and one or more solid additive inlets wherein at least one of the one or more filament inlets is positioned in the forming box at a non-90° angle, for example at an angle of less than 90°, relative to at least one of the one or more solid additive inlets; and b. introducing one or more filaments into the forming box through at least one of the filament inlets and introducing one or more solid additives into the forming box through at least one of the solid additive inlets such that the one or more filaments contact the one or more solid additives inside the forming box at a non-90° angle, for example at an angle of less than 90°, relative to one another, is provided.

In even another example of the present invention, a coforming process comprising the steps of:

a. providing a single stream of filaments;

b. providing two or more streams of solid additives, for example fibers; and c. commingling the single stream of filaments with the two or more streams of solid additives, is provided.

In even another example of the present invention, a coforming process comprising the steps of:

a. providing a single stream of filaments;

b. providing two or more streams of solid additives, for example fibers; and c. commingling the single stream of filaments with the two or more streams of solid additives inside a forming box, is provided.

In yet another example of the present invention, a coforming process comprising the steps of:

a. providing two or more streams of filaments;

b. providing two or more streams of solid additives, for example fibers; and c. commingling the two or more streams of the filaments with the two or more streams of solid additives, is provided.

In yet another example of the present invention, a coforming process comprising the steps of:

a. providing two or more streams of filaments;

b. providing two or more streams of solid additives, for example fibers; and c. commingling the two or more streams of the filaments with the two or more streams of solid additives inside a forming box, is provided.

In even still yet another example, a process for making a fibrous structure, the process comprising the steps of:

a. providing a die comprising one or more filament-forming holes, wherein one or more fluid-releasing holes are associated with one filament-forming hole such that a fluid exiting the fluid-releasing hole is parallel or substantially parallel to an exterior surface of a filament exiting the filament-forming hole;

b. supplying at least a first polymer to the die;

c. producing a plurality of filaments comprising the first polymer from the die;

d. combining the filaments with solid additives inside a forming box such that the filaments and solid additives contact each other at a non-90° angle, for example at an angle of less than 90°, relative to each other to form a mixture; and e. collecting the mixture on a collection device to produce a fibrous structure.

In even still yet another example, a process for making a fibrous structure, the process comprising the steps of:

a. providing a die comprising one or more filament-forming holes;

b. supplying at least a first polymer to the die;

c. producing a plurality of filaments comprising the first polymer from the die;

d. combining the filaments with solid additives inside a forming box such that the filaments and solid additives contact each other, for example at a non-90° angle, such as at an angle of less than 90°, relative to each other to form a mixture; and e. collecting the mixture on a collection device to produce a fibrous structure.

In one example, the angles associated with the forming box and/or inlets of the forming box, for example that impact the angle at which a first material, for example filaments, is contacted by a second material, for example a solid additive, is controllable and/or adjustable, for example during operation.

Accordingly, the present invention provides coforming processes and forming boxes useful therein.

DETAILED DESCRIPTION OF THE INVENTION

Definitions

"Coforming" and/or "coforming process" as used herein means a process by which two or more separate materials are commingled. In one example, coforming comprises a process by which one or more and/or two or more first materials, for example filaments, such as polymer filaments, are commingled with one or more and/or two or more second materials, for example solid additives, such as fibers, for example pulp fibers. In coforming processes two or more separate materials are commingled together to form a mixture of the two or more materials. For example, in a coforming process filaments can be commingled with fibers to form a mixture of filaments and fibers that can be collected to form a fibrous structure according to the present invention.

Figure 4A:
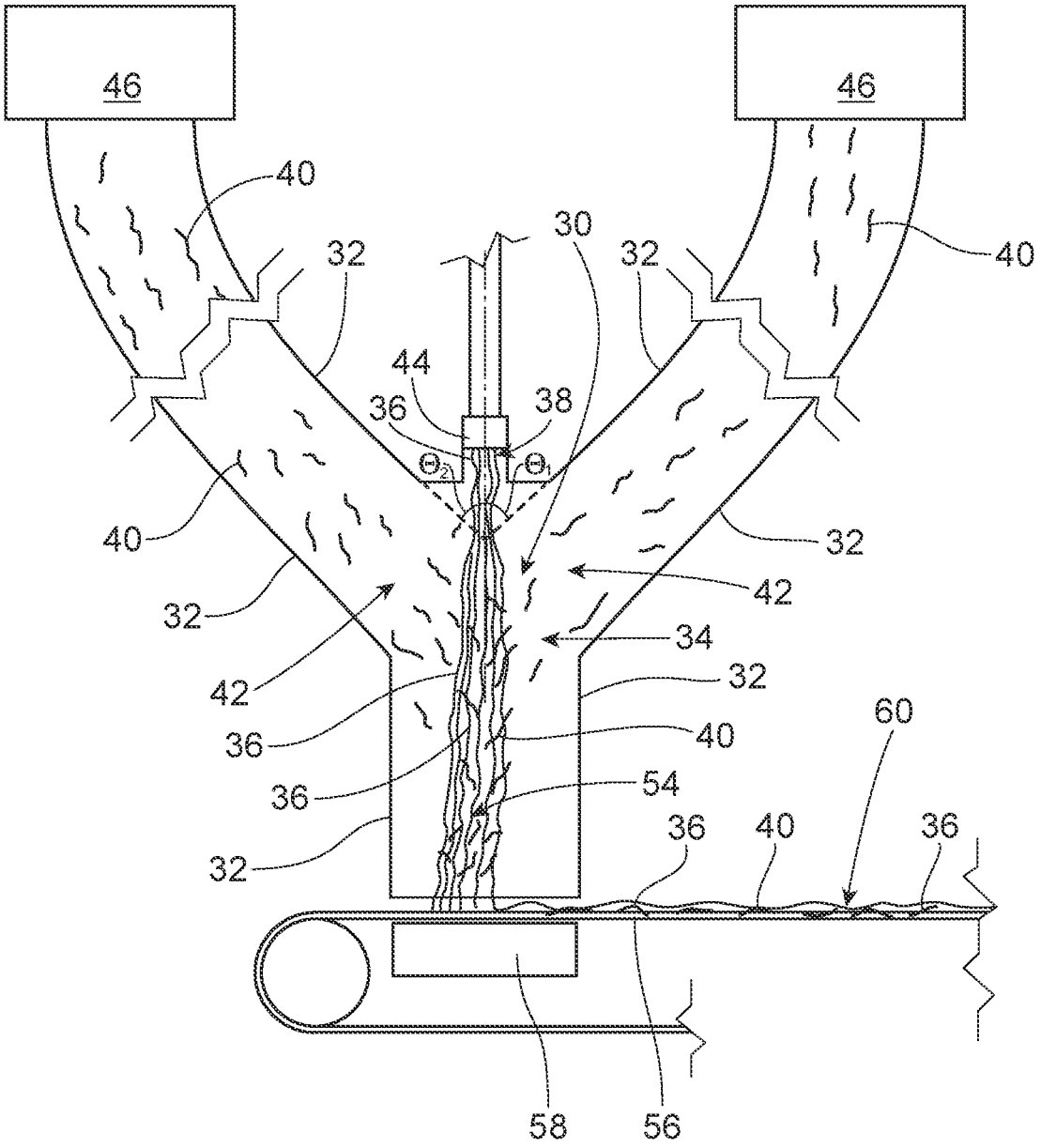
FIG. 4A is a cross-sectional, schematic view of an example of a forming box in accordance with the present invention used in a coforming process of the present invention.
Figure 4B:
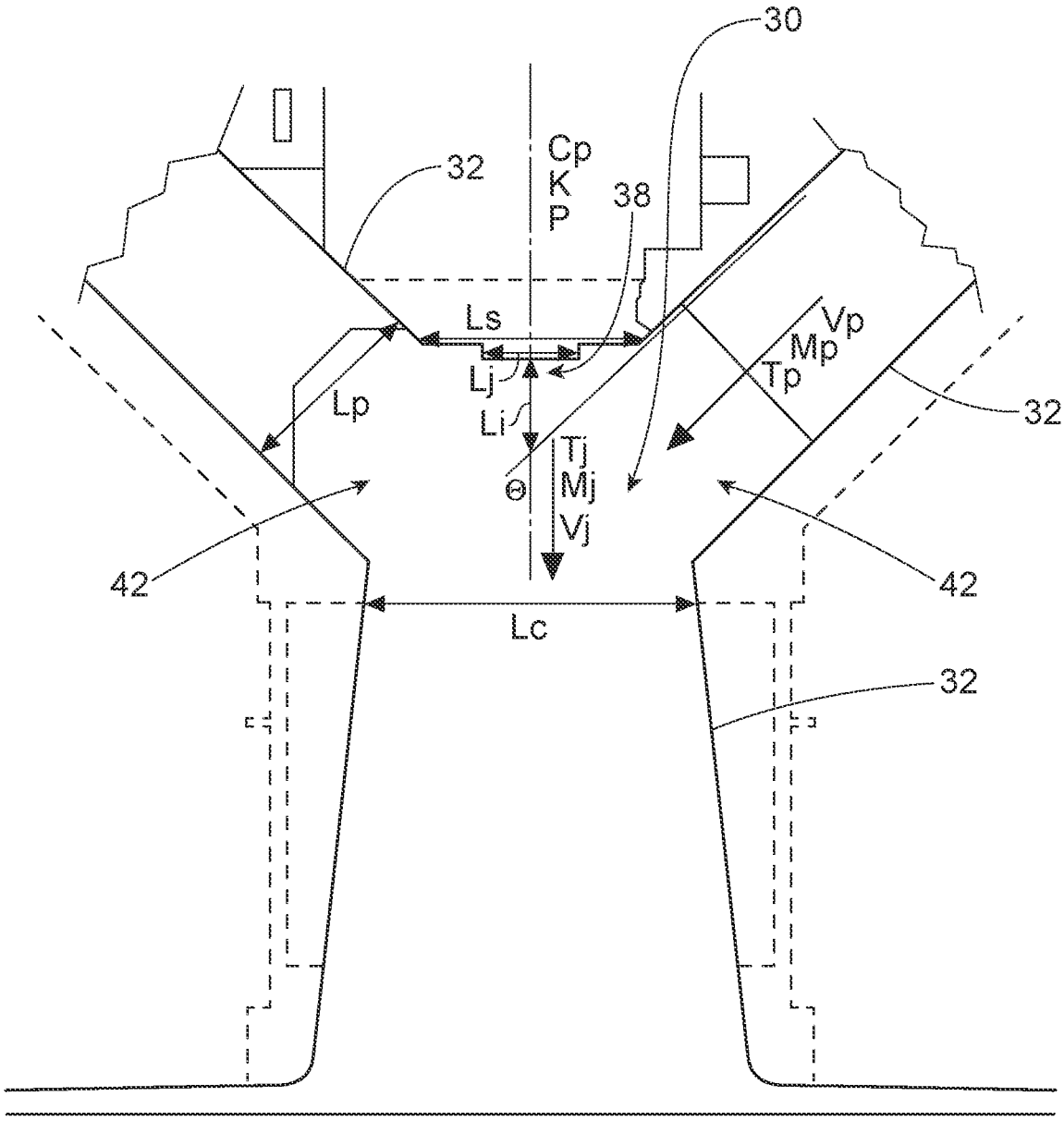
FIG. 4B is a cross-sectional, schematic view of another example of a forming box in accordance with the present invention.

"JAR" as used herein means the mass ratio of air between one of the side streams of air and the center stream of air, or Mp/Mj as shown in the FIG. 4B.

"Momentum" is a vector quantity, defined as mass times the velocity vector.

"Housing" as used herein means an enclosed or partially-enclosed volume formed by one or more walls through which one or more materials pass.

"Forming box" as used herein means a portion of a housing's volume within which commingling of two or more separate materials occurs. In one example, the forming box is a portion of the housing within which one or more and/or two or more first materials, for example filaments, such as polymer filaments, are commingled with one or more and/or two or more second materials, for example solid additives, such as fibers, for example pulp fibers. The forming box comprises two or more inlets for receiving two or more separate materials to be commingled. In one example, the forming box further comprises at least one outlet for evacuating the mixture of materials from the forming box. In one example, the forming box's at least one outlet opens to a collection device, for example a fabric and/or belt, such as a patterned belt, for receiving the mixture of materials, for example filaments and fibers, resulting in a fibrous structure. The receipt by the collection device of the mixture of materials may be aided by a vacuum box. The forming box may be a stand alone, separate, discrete, modular device that can be inserted into a machine, such as a fibrous structure making machine, and/or it may be a fully integrated component of a larger machine, such as a fibrous structure making machine so long as at least one first material and at least one second material, are capable of entering the forming box and commingling with one another according to the present invention.

"First material" as used herein means a material that is separate from at least one other material, for example a second material. In one example, the first material comprises filaments, such as polymer filaments.

"Second material" as used herein means a material that is separate from the first material. In one example, the second material comprises solid additives, such as fibers, for example pulp fibers.

"Stream(s) of solid additives" as used herein means a plurality of solid additives, for example a plurality of fibers, that are moving generally in the same direction. In one example, a stream of solid additives is a plurality of solid additives that enter a forming box of the present invention through the same solid additive inlet at the same time or substantially the same time.

"Stream(s) of filaments" as used herein means a plurality of filaments that are moving generally in the same direction. In one example, a stream of filaments is a plurality of filaments that enter a forming box of the present invention through the same filament inlet at the same time or substantially the same time. In one example, the stream of filaments may be a stream of meltblown filaments and/or a stream of spunbond filaments.

"Stream(s) of fibers" as used herein means a plurality of fibers that are moving generally in the same direction. In one example, a stream of fibers is a plurality of fibers that enter a forming box of the present invention through the same fiber inlet at the same time or substantially the same time. In one example, the stream of fibers may be a stream of pulp fibers.

"Filament inlet" as used herein means an entrance to the forming box through which one or more filaments enter.

"Solid additive inlet" as used herein means an entrance to the forming box through which one or more solid additives enter. A "fiber inlet" is an example of a solid additive inlet wherein the fiber inlet means an entrance to the forming box through which one or more fibers enter.

"Fibrous structure" as used herein means a structure that comprises one or more filaments and/or one or more fibers, which are considered solid additives for the present invention. In one example, a fibrous structure according to the present invention means an orderly arrangement of filaments and solid additives within a structure in order to perform a function. Non-limiting examples of fibrous structures of the present invention include paper, fabrics (including woven, knitted, and non-woven), and absorbent pads (for example for diapers or feminine hygiene products).

In one example, the fibrous structure is wound on a roll, for example in a plurality of perforated sheets, and/or cut into discrete sheets.

The fibrous structures of the present invention may be homogeneous or may be layered. If layered, the fibrous structures may comprise at least two and/or at least three and/or at least four and/or at least five layers.

The fibrous structures of the present invention are co-formed fibrous structures.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Solid additive" as used herein means a fiber and/or a particulate.

"Particulate" as used herein means a granular substance, powder and/or particle, such as an absorbent gel material particle.

"Fiber" and/or "Filament" as used herein means an elongate particulate having an apparent length greatly exceeding its apparent width, i.e. a length to diameter ratio of at least about 10. For purposes of the present invention, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include wood pulp fibers and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments. In one example, the polymer filaments of the present invention comprise a thermoplastic polymer, for example a thermoplastic polymer selected from the group consisting of: polyeolefins, such as polypropylene and/or polyethylene, polyesters, polyvinyl alcohol, nylons, polylactic acid, polyhydroxyalkanoate, polycaprolactone, and mixtures thereof. In one example, the thermoplastic polymer comprises a polyolefin, for example polypropylene and/or polyethylene. In another example, the thermoplastic polymer comprises polypropylene.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

"Sanitary tissue product" as used herein means a soft, low density (i.e.<about 0.15 g/cm3) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present invention may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may exhibit a total absorptive capacity of according to the Horizontal Full Sheet (HFS) Test Method described herein of greater than about 10 g/g and/or greater than about 12 g/g and/or greater than about 15 g/g and/or from about 15 g/g to about 50 g/g and/or to about 40 g/g and/or to about 30 g/g.

The sanitary tissue products of the present invention may exhibit a Vertical Full Sheet (VFS) value as determined by the Vertical Full Sheet (VFS) Test Method described herein of greater than about 5 g/g and/or greater than about 7 g/g and/or greater than about 9 g/g and/or from about 9 g/g to about 30 g/g and/or to about 25 g/g and/or to about 20 g/g and/or to about 17 g/g.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets. In one example, one or more ends of the roll of sanitary tissue product may comprise an adhesive and/or dry strength agent to mitigate the loss of fibers, especially wood pulp fibers from the ends of the roll of sanitary tissue product.

The sanitary tissue products of the present invention may comprises additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, and other types of additives suitable for inclusion in and/or on sanitary tissue products.

"Basis Weight" as used herein is the weight per unit area of a sample reported in lbs/3000 $ft^2$ or $g/m^2$.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Total Pore Volume" as used herein means the sum of the fluid holding void volume in each pore range from 1 μm to 1000 μm radii as measured according to the Pore Volume Test Method described herein.

"Pore Volume Distribution" as used herein means the distribution of fluid holding void volume as a function of pore radius. The Pore Volume Distribution of a fibrous structure is measured according to the Pore Volume Test Method described herein.

"Additives" as used herein means the additives solid additives, liquid additives, gas additives, plasma additives, and mixtures thereof. Even though the examples exemplified herein are directed to solid additives, other additives may be utilized with the forming boxes of the present invention. In one example, the additive is a solid additive, such as pulp, for example wood pulp fibers. In another example, the additive may comprise a liquid additive, for example a liquid additive comprising a dissolved solid additive that precipitates in the forming box during operation.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Forming Box

FIGS. 4A and 4B show examples of forming boxes 30 of the present invention. The forming boxes 30 are defined by a housing 32. The housing 32 may be made from any suitable material such as metal, polycarbonate, or glass. The housing 32 encloses and/or defines the forming boxes' volume 34 where at least a first material, for example one or more filaments 36, for example polymer filaments such as polyolefin filaments (e.g., polypropylene filaments), which enters the forming box 30 through one or more first material inlets, for example filament inlets 38, and at least a second material, for example one or more solid additives 40, such as fibers, for example pulp fibers (e.g., wood pulp fibers), which enters the forming box 30 through one or more second material inlets, for example solid additive inlets 42, commingle.

In one example as shown in FIG. 4A, the first material, for example filaments 36, commingle with the second material, for example fibers 40, inside the forming box's volume 34 defined by the housing 32 as a result of the second material, for example fibers 40, contacting the first material, for example filaments 34, at an angle $\theta_1$ and/or $\theta_2$, at least one of which is not 90° (a non-90° angle), for example at an angle of less than 90° and/or less than 85° and/or less than 75° and/or less than 45° and/or less than 30° and/or to about 0° and/or to about 10° and/or to about 25°.

In one example, at least one of the first material inlets, for example filament inlets 38, is positioned within the housing 32 at a non-90° angle, for example at an angle of less than 90° and/or less than 85° and/or less than 75° and/or less than 45° and/or less than 30° and/or to about 0° and/or to about 10° and/or to about 25° with respect to at least one of the second material inlets, for example solid additive inlets 42. This non-90° angle can be achieved by various ways, for example by fixed designs of the first material inlets and/or second material inlets and/or by controllable and/or adjustable designs of the first material inlets and/or second material inlets.

In another example, one or more first material inlets, for example filament inlets 38, may be in fluid communication with a first material source, such as a filament source for example a polymer filament source comprising a spinnerette, such as a die 44, that supplies filaments 36 to at least one of the filament inlets 38.

In another example, one or more second material inlets, for example solid additive inlets 42 is in fluid communication with an additive source, for example a solid additive source, such as a fiber source 46, such as a fiber spreader and/or a hammermill and/or a forming head and/or eductor, that supplies fibers 40 to at least one of the solid additive inlets 42.

As shown in FIG. 4B, an example of a forming box, for example coform box, according to the present invention may exhibit the following dimensions and/or ratios of the dimensions. In one example, dimension Lj may be greater than 0.03 and/or greater than 0.05 and/or greater than 0.075 and/or greater than 0.1 and/or greater than 0.125 and/or less than 10 and/or less than 7 and/or less than 5 and/or less than 3 inches. In another example, dimension Lj is from about 0.125 to about 3 inches. In one example, dimension Lp may be greater than 0.1 and/or greater than 0.25 and/or greater than 0.5 and/or greater than 0.75 and/or greater than 1 and/or less than 15 and/or less than 12 and/or less than 10 and/or less than 8 and/or less than 6 inches. In another example, dimension Lp is from about 1 to about 6 inches. In one example, dimension Lc may be greater than 0.5 and/or greater than 0.75 and/or greater than 1 and/or greater than 1.25 and/or greater than 1.5 and/or greater than 2 and/or less than 30 and/or less than 25 and/or less than 20 and/or less than 15 and/or less than 12 inches. In another example, dimension Lc is from about 2 to about 12 inches. In one example, dimension Ls may be greater than 0.1 and/or greater than 0.25 and/or greater than 0.5 and/or greater than 0.75 and/or greater than 1 and/or less than 30 and/or less than 25 and/or less than 20 and/or less than 15 and/or less than 12 inches. In another example, dimension Ls is from about 1 to about 12 inches. In one example, the forming box of the present invention exhibits dimension ratios of Lc:Ls of less than 12:1 and/or less than 12:7 and/or less than 7:7 and/or less than 3:7. In another example, the forming box of the present invention exhibits dimension ratios of Lc:Lp of less than 12:1 and/or less than 11:4 and/or less than 7:4 and/or less than 3:4.

In one example, a coforming process that utilizes a forming box of the present invention, for example as shown in FIG. 4A or 4B, exhibits a JAR during operation of at least 0.5 and/or at least 1 and/or at least 1.5 and/or at least 2 and/or at least 2.5 and/or at least 3.0 and/or at least 3.5 and/or at least 4.0 and/or less than 15 and/or less than 12 and/or less than 10 and/or less than 8.

In another example, a fibrous structure made from a coforming process of the present invention, for example that uses a forming box in accordance with the present invention, for example as shown in FIG. 4A or 4B, exhibits a MD Basis Weight Coefficient of Variation (COV) of less than 11% and/or less than 10% and/or less than 8% and/or less than 6% and/or about 0% and/or greater than 0.5% as measured according to the MD Basis Weight Test Method described herein.

In yet another example, a fibrous structure made from a coforming process of the present invention, for example that uses a forming box in accordance with the present invention, for example as shown in FIG. 4A or 4B, wherein the coforming process exhibits a JAR during operation of at least 0.5 and/or at least 1 and/or at least 1.5 and/or at least 2 and/or at least 2.5 and/or at least 3.0 and/or at least 3.5 and/or at least 4.0 and/or less than 15 and/or less than 12 and/or less than 10 and/or less than 8 exhibits a MD Basis Weight Coefficient of Variation (COV) of less than 11% and/or less than 10% and/or less than 8% and/or less than 6% and/or about 0% and/or greater than 0.5% as measured according to the MD Basis Weight Test Method described herein.

MD Basis Weight COV data for fibrous structures (Inventive A-D) of the present invention made according to the present invention and/or using the coforming processes of the present invention and the forming boxes of the present invention are shown in Table 1 below along with examples of known fibrous structures (1-4) that were made without using the processes and/or forming boxes of the present invention.

| Sample | MD Basis Weight COV |
|---|---|
| 1 | 13.1% |
| 2 | 11.6% |
| 3 | 12.8% |
| 4 | 13.5% |
| Inventive A | 6.8% |
| Inventive B | 7.6% |
| Inventive C | 5.1% |
| Inventive D | 4.7% |

In one example of the present invention, a forming box comprises one or more filament inlets and one or more solid additive inlets, wherein at least one of the filament inlets is in fluid communication with a filament source and at least one of the solid additive inlets is in fluid communication with an additive source, for example a solid additive source, such that during operation of the forming box one or more filaments enter the forming box through the at least one filament inlet and one or more solid additives enter the forming box through the at least one solid additive inlet such that the one or more filaments and the one or more solid additives contact each other at a non-90° angle, for example at an angle of less than 90°.

In another example of the present invention, a forming box comprises one or more filament inlets and one or more solid additive inlets wherein at least one of the one or more filament inlets and at least one of the one or more solid additive inlets are positioned in the housing at a non-90° angle, for example at an angle of less than 90° and/or less than 85° and/or less than 75° and/or less than 45° and/or less than 30° and/or to about 0° and/or to about 10° and/or to about 25° relative to one another. This non-90° angle can be achieved by various ways, for example by fixed orientation of the filament inlets and/or solid additive inlets within the housing and/or by controllable and/or adjustable orientations of the filament inlets and/or solid additive inlets within the housing.

In still another example of the present invention, a forming box comprises one or more filament inlets and one or more solid additive inlets wherein at least one of the one or more filament inlets and at least one of the one or more solid additive inlets are positioned in the housing such that filaments entering the forming box through at least one of the filament inlets and solid additives entering the forming box through at least one of the solid additive inlets contact each other inside the forming box at a non-90° angle, for example at an angle of less than 90°, relative to one another.

In even still another example of the present invention, a forming box comprises one or more filament inlets and one or more solid additive inlets such that filaments entering the forming box through at least one of the filament inlets and solid additives entering the forming box through at least one of the solid additive inlets contact each other at a non-90° angle, for example at an angle of less than 90°, relative to one another.

In yet another example of the present invention, a forming box comprises one or more filament inlets and two or more solid additive inlets such that filaments entering the forming box through at least one of the filament inlets and solid additives entering the forming box through at least two of the solid additive inlets contact each inside the forming box.

In still yet another example of the present invention, a forming box comprises two or more filament inlets and two or more solid additive inlets such that filaments entering the forming box through at least one of the filament inlets and solid additives entering the forming box through at least one of the solid additive inlets contact each other inside the forming box.

In one example, the housing is designed to inhibit and/or prevent and/or mitigate buildup and/or deposition of materials, such as filaments and/or solid additive on the walls of the housing. In one example, the housing is subjected to heat prior to, during, and/or after the coforming process.

In another example, the forming box may comprise, in addition to the first material inlets and the second material inlets, a plurality of other material inlets, such as an inlet for steam and/or moisture. The orientation of these other material inlets may be the same or different as described above with respect to the first and second material inlets, for example regarding angles relating to the positioning of the other material inlets within the housing defining the volume of the forming box.

In one example, the forming box (coform box) of the present invention is geometrically symmetric with respect to the forming box's cross machine-direction axis. In another example, the forming box (coform box) of the present invention exhibits symmetric momentum with respect to the forming box's cross machine-direction axis. In still another example, the forming box (coform box) of the present invention exhibits symmetric horizontal momentum with respect to the forming box's cross machine-direction axis.

In one example, the inlets, for example at least two of the additive inlets, are independently controllable during operation, for example independently controllable with respect to concentration, type of additive, composition, aspect ratio of additive, and mixtures thereof.

In another example, the filament inlets, for example at least two of the polymer filament inlets are independently controllable during operation, for example independently controllable with respect to concentration, type of polymer, composition, and mixtures thereof.

Coforming Process

A non-limiting example of a coforming process is also shown in FIGS. 4A and 4B. In one example, as shown in FIGS. 4A and 4B, a coforming process comprises the steps of:

a. providing a forming box 30 defined by a housing 32, wherein the forming box 30 comprises one or more first discrete material inlets, for example one or more filament inlets 38 and one or more second material inlets, for example one or more solid additive inlets 42; and b. introducing one or more filaments 36 into the forming box 30 through at least one of the one or more first material inlets, for example one or more filament inlets 38, and introducing one or more solid additives 40, such as fibers, into the forming box 30 through at least one of the one or more second material inlets, for example one or more solid additive inlets 42, such that the one or more filaments 36 contact the one or more solid additives 40, for example fibers, inside the volume 34 defined by the housing 32 at a non-90° angle, for example at an angle of less than 90° and/or less than 85° and/or less than 75° and/or less than 45° and/or less than 30° and/or to about 0° and/or to about 10° and/or to about 25°, relative to one another, is provided.

In one example, as shown in FIG. 4B, the housing 32 that defines the forming box 30 (coform box), exhibits a downwardly flaring section from the one or more solid additive inlets 42 to an exit of the forming box 30 (coform box).

Another example of a coforming process according to the present invention is also shown in FIGS. 4A and 4B. This coforming process comprises the steps of:

a. providing a forming box 30 defined by a housing 32, wherein the forming box 30 comprises one or more first discrete material inlets, for example one or more filament inlets 38 and one or more second material inlets, for example one or more solid additive inlets 42, wherein at least one of the one or more filament inlets 38 is positioned in the housing 32 at a non-90° angle, for example at an angle of less than 90° and/or less than 85° and/or less than 75° and/or less than 45° and/or less than 30° and/or to about 0° and/or to about 10° and/or to about 25°, relative to at least one of the one or more solid additive inlets; and b. introducing one or more filaments 36 into the forming box 30 through at least one of the filament inlets 38 and introducing one or more solid additives 40 into the forming box 30 through at least one of the solid additive inlets 42 such that the one or more filaments 36 contact the one or more solid additives 40 inside the volume 34 defined by the housing 32 at a non-90° angle, for example at an angle of less than 90° and/or less than 85° and/or less than 75° and/or less than 45° and/or less than 30° and/or to about 0° and/or to about 10° and/or to about 25°, relative to one another.

In even another example as shown in FIGS. 4A and 4B, a coforming process comprising the steps of:

a. providing a single stream of filaments 36;

b. providing two or more streams of solid additives 40, for example fibers; and c. commingling the single steam of filaments 36 with the two or more streams of solid additives 40. This coforming process example may or may not include the use of a forming box 30. In one example, the coforming process does include the use of a forming box 30 wherein the single stream of filaments 36 and the two or more streams of solid additives 40, such as a fibers, commingle by the two or more streams of solid additives 40 contacting the single stream of filaments 36 inside the volume 34 defined by the housing 32 at a non-90° angle, for example at an angle of less than 90° and/or less than 85° and/or less than 75° and/or less than 45° and/or less than 30° and/or to about 0° and/or to about 10° and/or to about 25°, relative to one another.

Figure 5:
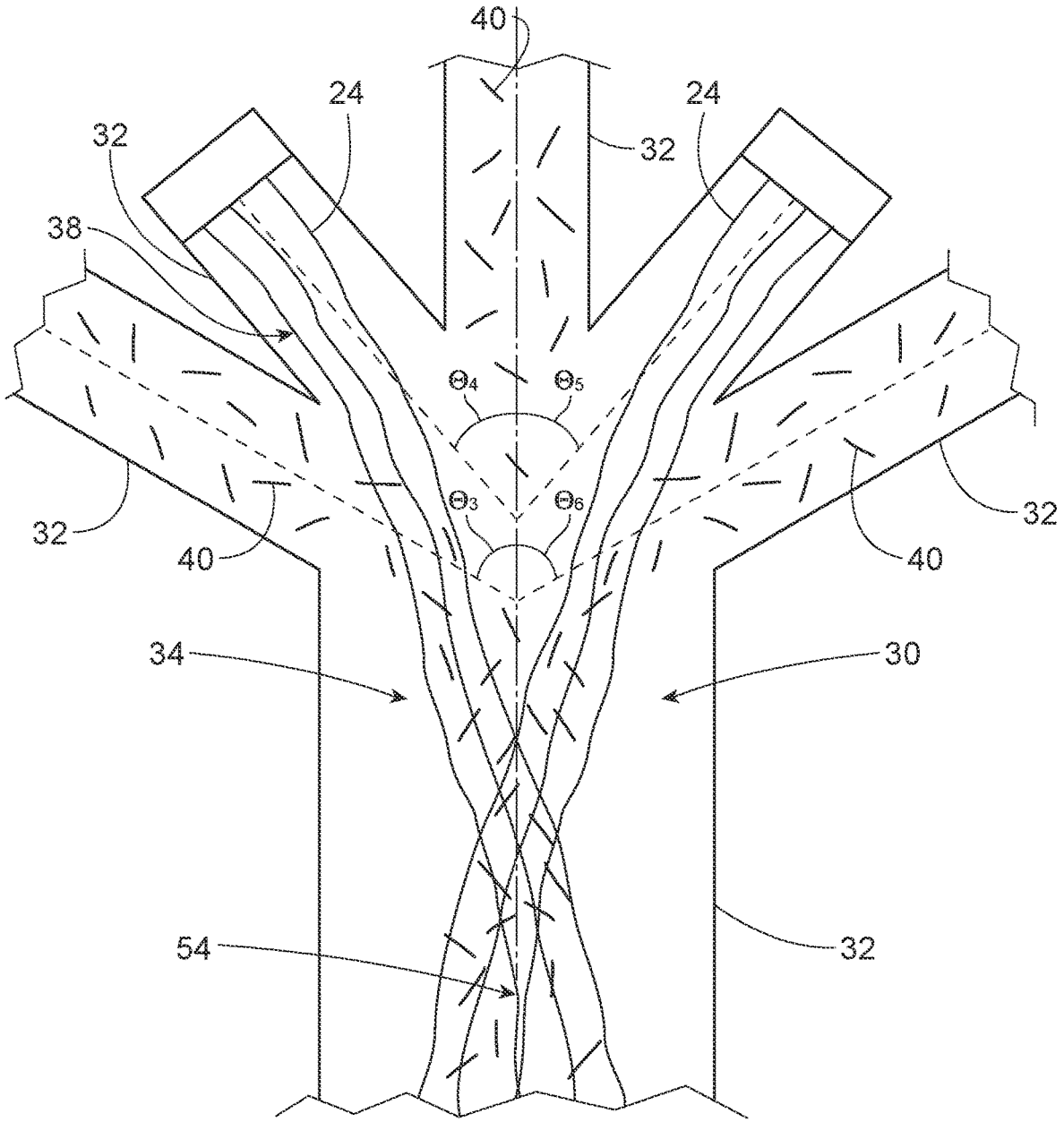
FIG. 5 is another example of a forming box in accordance with the present invention.

In even another example of the present invention as shown in FIG. 5, a coforming process comprising the steps of:

a. providing two or more streams of filaments 36;

b. providing two or more streams of solid additives 40, for example fibers; and c. commingling the two or more streams of the filaments 36 with the two or more streams of solid additives 40, is provided. This coforming process example may or may not include the use of a forming box 30. In one example, the coforming process does include the use of a forming box 30 wherein the two or more streams of filaments 36 and the two or more streams of solid additives 40, such as a fibers, commingle by the two or more streams of solid additives 40 contacting the two or more streams of filaments 36 inside the volume 34 defined by the housing 32 at a non-90° angle (angled $\theta_3$, $\theta_4$, $\theta_5$, and $\theta_6$) for example at an angle of less than 90° and/or less than 85° and/or less than 75° and/or less than 45° and/or less than 30° and/or to about 0° and/or to about 10° and/or to about 25°, relative to one another.

Process for Making a Fibrous Structure

Figure 7:
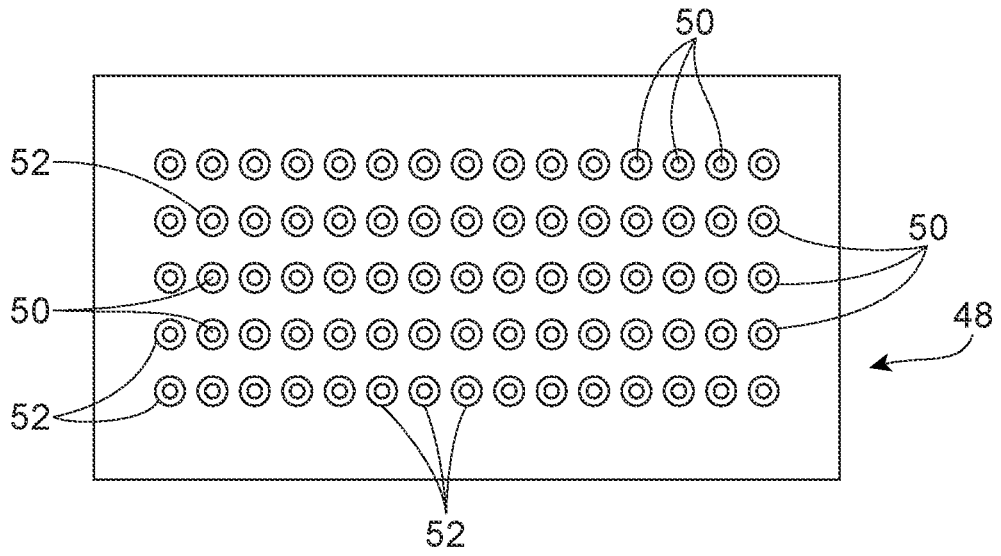
FIG. 7 is an example of a die useful in the coforming processes of the present invention.
Figure 8:
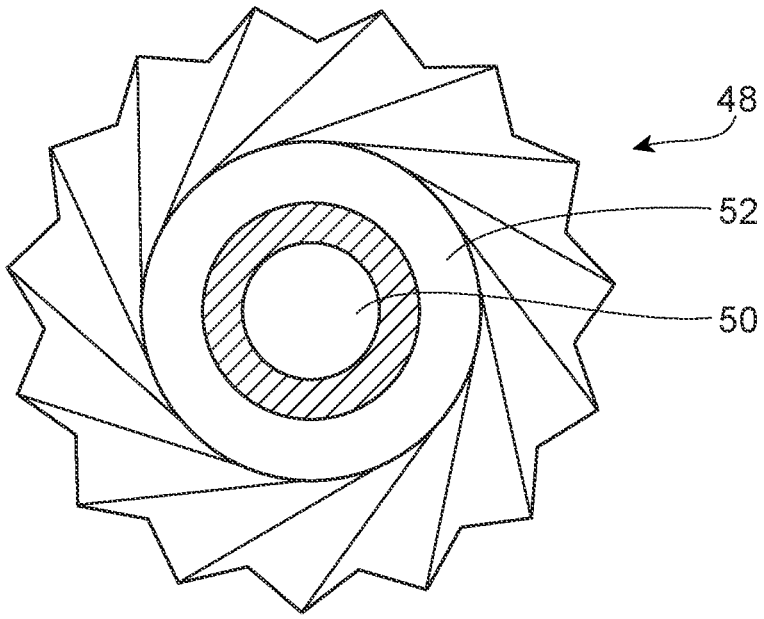
FIG. 8 is a partial, expanded view of the die shown in FIG. 7.

As shown in FIGS. 4A and 4B, a non-limiting example of a process for making a fibrous structure according to the present invention comprises the steps of:

a. providing a filament source 44 comprising a die 48 (as shown in FIGS. 7 and 8), for example a multi-row capillary die, comprising one or more filament-forming holes 50, wherein one or more fluid-releasing holes 52 are associated with one filament-forming hole 50 such that a fluid, such as air, exiting the fluid-releasing hole 52 is parallel or substantially parallel (less than 45° and/or less than 30° and/or less than 20° and/or less than 15° and/or less than 10° and/or less than 5° and/or less than 3° and/or about 0° to an exterior surface of a filament exiting the filament-forming hole 50;

b. supplying at least a first polymer to the die 48;

c. producing a plurality of filaments 36 comprising the first polymer from the die 48;

d. combining the filaments 36 with solid additives 40 delivered from a solid additive source 46, such as a hammermill and/or solid additive spreader and/or airlaying equipment such as a forming head, for example a forming head from Dan-Web Machinery A/S, and/or an eductor, inside a forming box 30 defined by a housing 32 that defines a forming box's volume 34 such that the filaments 36 and solid additives 40 contact each other at a non-90° angle, for example at an angle of less than 90° and/or less than 85° and/or less than 75° and/or less than 45° and/or less than 30° and/or to about 0° and/or to about 10° and/or to about 25°, relative to each other to form a mixture; and e. collecting the mixture 54 on a collection device 56, such as a fabric and/or belt, for example a patterned belt that imparts a pattern, for example a non-random, repeating pattern to a fibrous structure, with or without the aid of a vacuum box 58, to produce a fibrous structure 60.

The forming box 30 may comprise one or more first material inlets, for example one or more filament inlets 38 through which one or more filaments 36, for example meltblown filaments, are introduced into the forming box 30, and one or more second material inlets, for example one or more solid additive inlets 42 through which one or more solid additives 40, such as fibers, are introduced into the forming box 30 such that one or more filaments 36 contact the one or more solid additives 40, for example fibers, inside the volume 34 of the forming box 30.

In another example of the present invention as shown in FIGS. 6A to 6E, a fibrous structure making process comprises the steps of:

a. providing a filament source 44, for example a die, such as a spunbond die or a meltblow die 48 as shown in FIGS. 7 and 8, which illustrates an example of a multi-row capillary die comprising one or more filament-forming holes 50, wherein one or more fluid-releasing holes 52 are associated with one filament-forming hole 50 such that a fluid, such as air, exiting the fluid-releasing hole 52 is parallel or substantially parallel (less than 45° and/or less than 30° and/or less than 20° and/or less than 15° and/or less than 10° and/or less than 5° and/or less than 3° and/or about 0° to an exterior surface of a filament exiting the filament-forming hole 50;

b. supplying at least a first polymer to the filament source 44;

c. producing a plurality of filaments 36 comprising the first polymer from the filament source 44;

d. combining the filaments 36 with solid additives 40 delivered from a solid additive source (not shown), such as a hammermill and/or solid additive spreader and/or airlaying equipment such as a forming head, for example a forming head from Dan-Web Machinery A/S, and/or an eductor, inside a forming box 30 defined by a housing 32 that defines a forming box's volume 34 such that the filaments 36 and solid additives 40 contact each other at a 90° angle and/or at a non-90° angle, for example at an angle of less than 90° and/or less than 85° and/or less than 75° and/or less than 45° and/or less than 30° and/or to about 0° and/or to about 10° and/or to about 25°, relative to each other to form a mixture; and e. collecting the mixture 54 on a collection device 56, such as a fabric and/or belt, for example a patterned belt that imparts a pattern, for example a non-random, repeating pattern to a fibrous structure, with or without the aid of a vacuum box 58, to produce a fibrous structure 60.

Figure 6A:
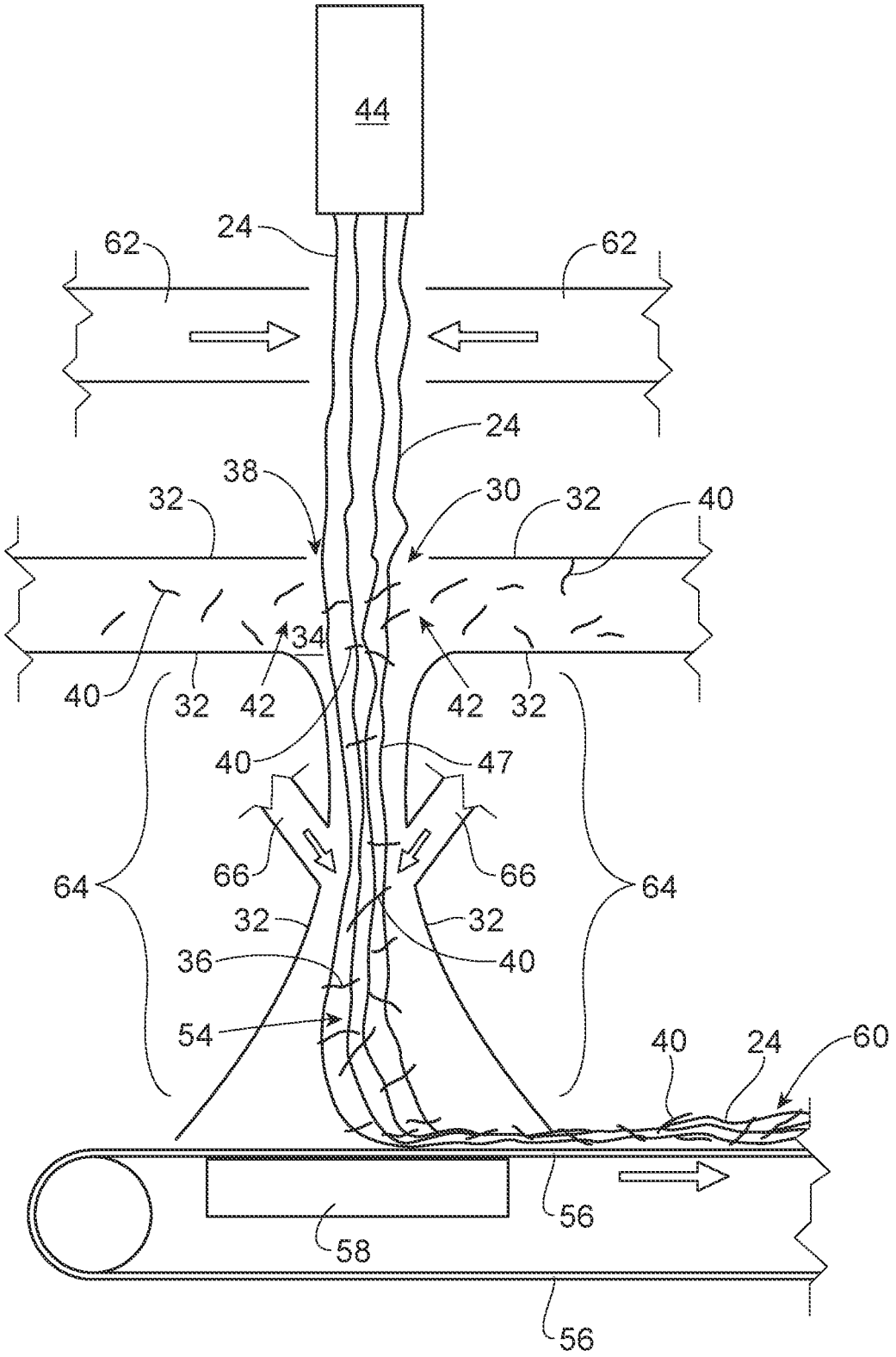
FIG. 6A is an example of a fibrous structure making process in accordance with the present invention.
Figure 6B:
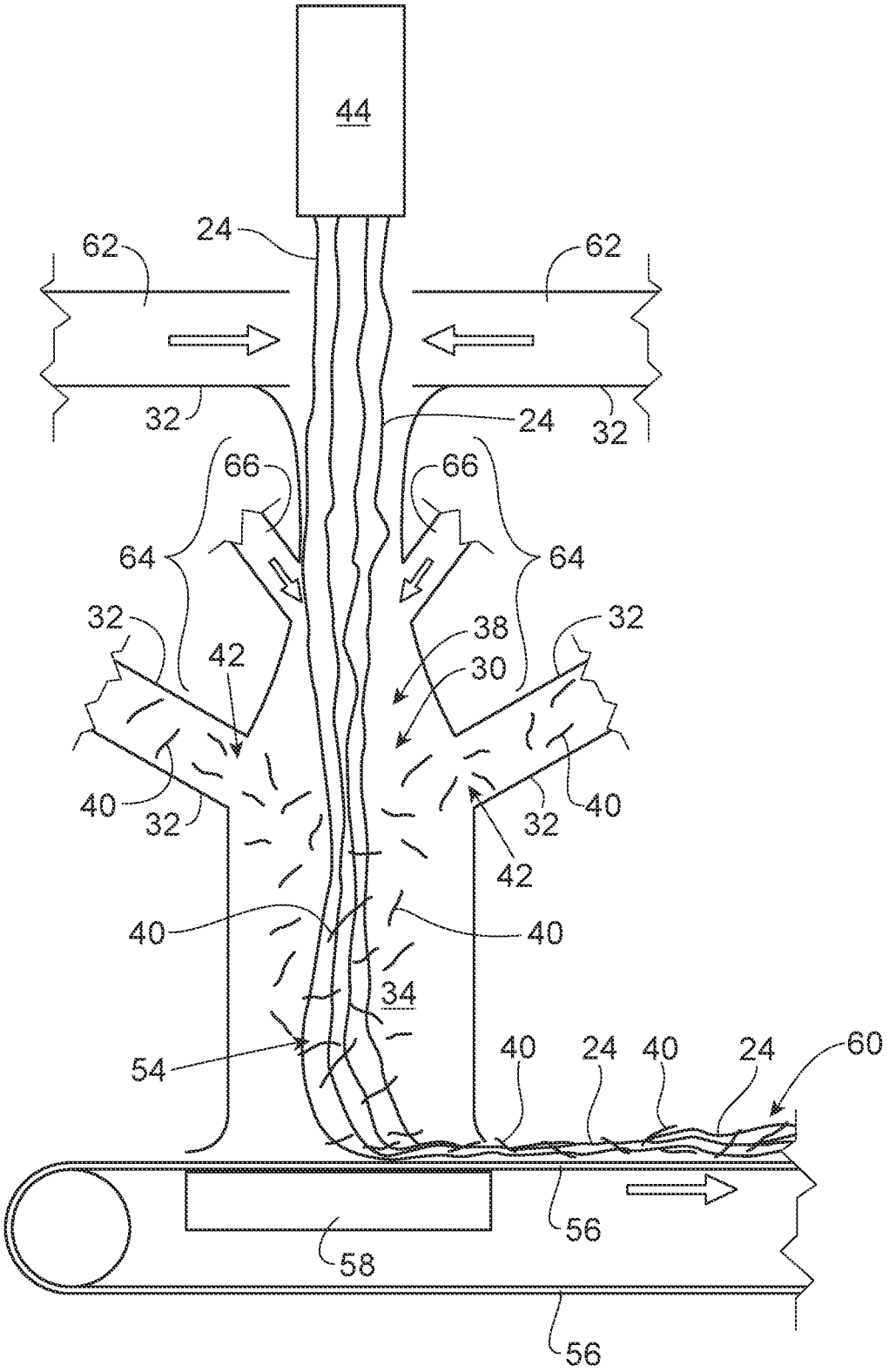
FIG. 6B is another example of a fibrous structure making process in accordance with the present invention.
Figure 6C:
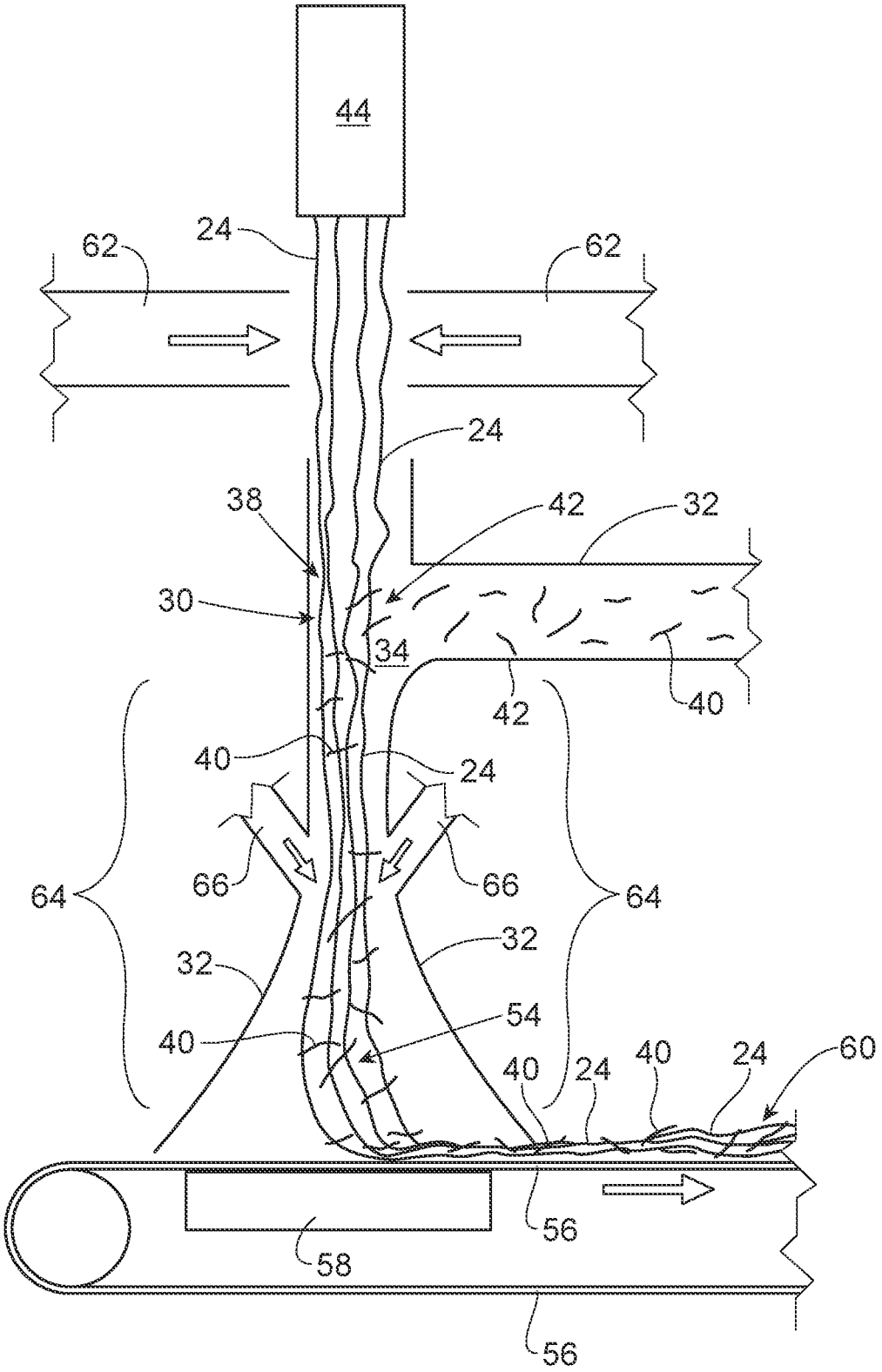
FIG. 6C is another example of a fibrous structure making process in accordance with the present invention.
Figure 6D:
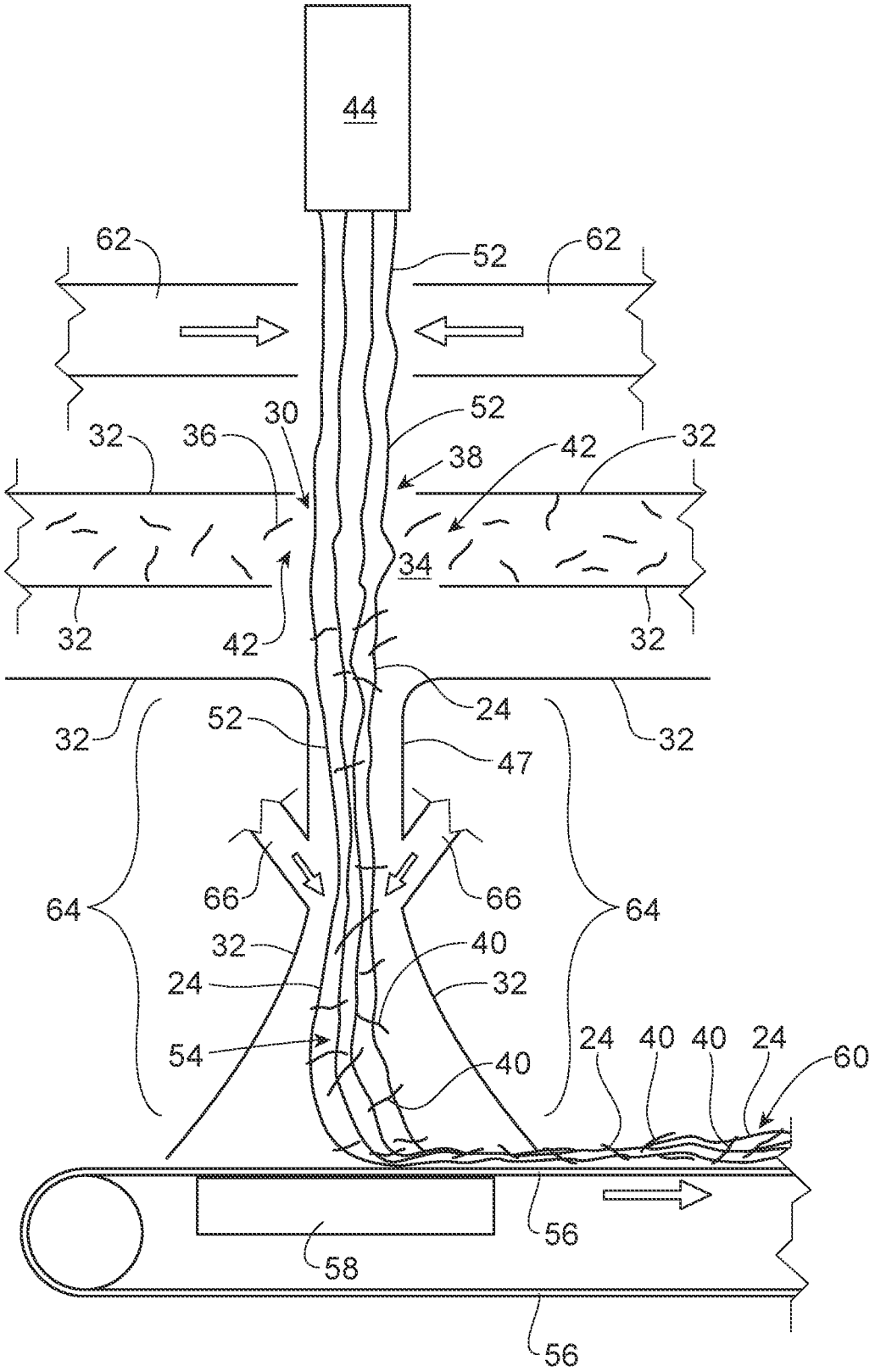
FIG. 6D is another example of a fibrous structure making process in accordance with the present invention.
Figure 6E:
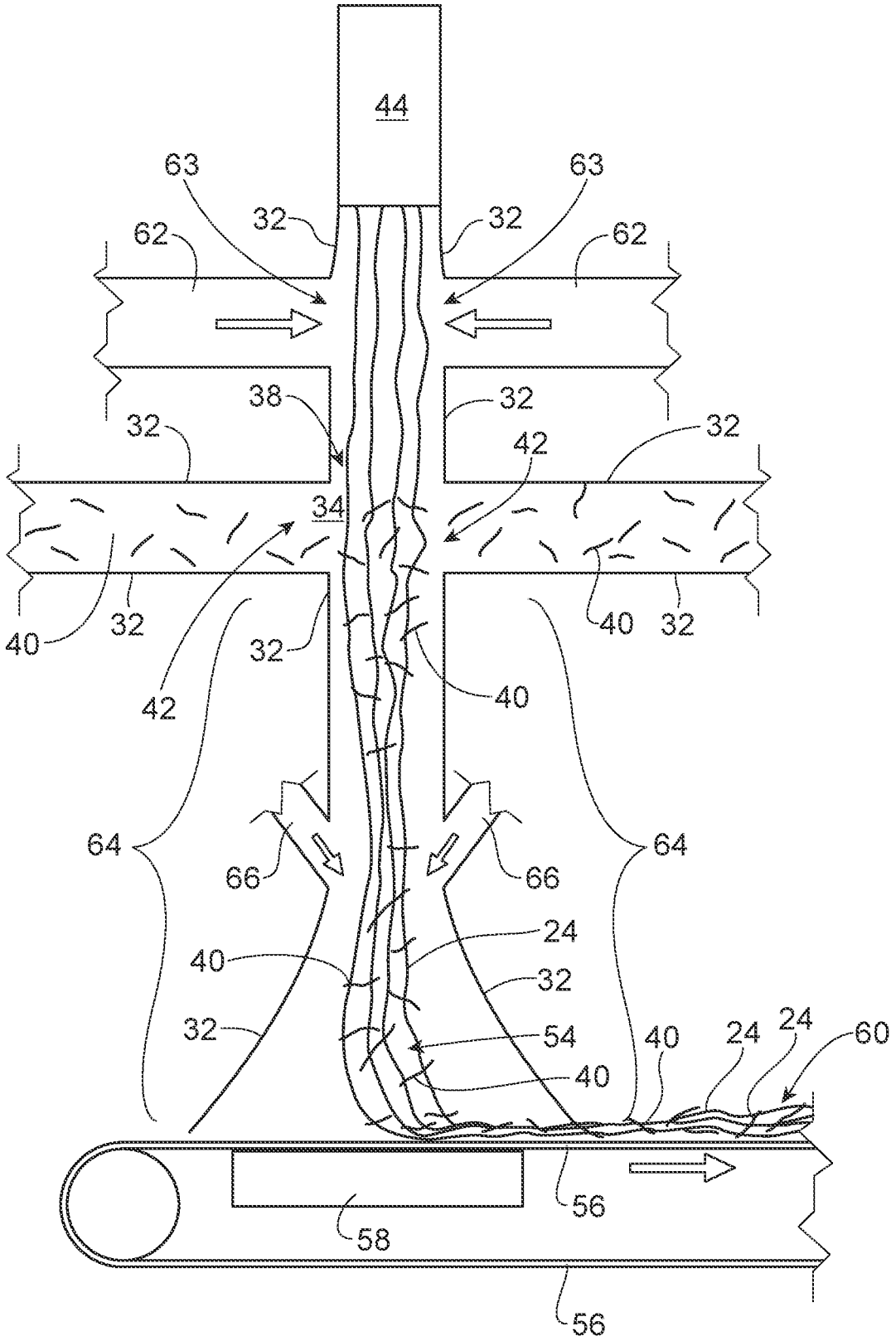
FIG. 6E is another example of a fibrous structure making process in accordance with the present invention.

The fibrous structure making process as shown in FIGS. 6A to 6E may further comprise one or more air sources 62, such as cooling air, quenching air, and/or drying air. In one example, as shown in FIG. 6E the components of the fibrous structure making process, for example the one or more filament sources 44, the one or more air sources 62, the forming box 30 along with its inlets 38 and 42 may all be connected to one another by housing 32.

In another example, as shown in FIGS. 6A to 6E, the fibrous structure making process may further comprise a venturi attenuation zone 64. In one example, the venturi attenuation zone 64 comprises one or more high velocity air sources 66 that delivers high velocity air to the filaments 36 prior to the forming box 30 (as shown in FIG. 6B) and/or to the mixture 54 of filaments 36 and solid additives 40 after the forming box 30 (as shown in FIGS. 6A, 6C, 6D, and 6E).

In one example, during operation, as shown in FIG. 6B, the filament source 44 receives molten polymer, for example a polyolefin, such as polypropylene, under pressure. This molten polymer is then spun via pressure from the filament source 44 (for example a die) to form filaments 36. The filaments 36 are subjected to cooling air, from one or more air sources 62, which serves to lower the molten polymer to below its freezing temperature. The filaments 36 continue traveling toward the collection device 56 and are aided in attenuation by the venturi attenuation zone 64. Subsequent to the venturi attenuation zone 64, one or more solid additives 40—laden flow is then introduced into the filaments 36 in the forming box 30. The filaments 36 are aided in attenuation by the venturi attenuation zone 64. The mixture 54 is then collected on the collection device 56, with or without the aid of the vacuum box 58, to form the fibrous structure 60. The fibrous structure 60 may then be subjected to further post processing operations such as thermal bonding, embossing, tuft-generating operations, slitting, cutting, perforating, and other converting operations.

In another example, during operation, as shown in FIGS. 6A, 6C, 6D, and 6E, the filament source 44 receives molten polymer, for example a polyolefin, such as polypropylene, under pressure. This molten polymer is then spun via pressure from the filament source 44 (for example a die) to form filaments 36. The filaments 36 are subjected to cooling air, from one or more air sources 62, which serves to lower the molten polymer to below its freezing temperature. The filaments 36 continue traveling toward the collection device 56. One or more solid additives 40—laden flow is then introduced into the filaments 36 in the forming box 30. The filaments 36 are aided in attenuation by the venturi attenuation zone 64. The mixture 54 is then collected on the collection device 56, with or without the aid of the vacuum box 58, to form the fibrous structure 60. The fibrous structure 60 may then be subjected to further post processing operations such as thermal bonding, embossing, tuft-generating operations, slitting, cutting, perforating, and other converting operations.

In one example, the forming box 30 (coform box), as shown in FIG. 6E, comprises one or more filament inlets 38, one or more cooling air inlets 63 through which cooling air enters the housing 32 from one or more air sources 62, one or more solid additive inlets 42, and one or more venturi attenuation zones 64, which aid in attenuation filaments 36 passing through the forming box 30 and/or the housing 32 defining the forming box 30.

The forming box 30 may comprise one or more first material inlets, for example one or more filament inlets 38 through which one or more filaments 36, for example spunbond filaments, are introduced into the forming box 30, and one or more second material inlets, for example one or more solid additive inlets 42 through which one or more solid additives 40, such as fibers, are introduced into the forming box 30 such that one or more filaments 36 contact the one or more solid additives 40, for example fibers, inside the volume 34 of the forming box 30.

In another example as shown in FIGS. 4A and 4B, a fibrous structure making process of the present invention comprises the step of commingling a plurality of solid additives 40 with a plurality of filaments 36. In one example, the solid additives 40 are wood pulp fibers, such as SSK fibers and/or Eucalytpus fibers, and the filaments 36 are polypropylene filaments. The solid additives 40 may be combined with the filaments 36, such as by being delivered to a stream of filaments 36 from a solid additive source 46 such as a hammermill via a solid additive spreader and/or forming head and/or eductor to form a mixture 54 of filaments 36 and solid additives 40. In one example, an apparatus for separating the solid additives 40 as described in US Patent Application Publication No. 20110303373 may be used to facilitate delivery of the solid additives 40. In one example, the solid additives 40 may be delivered to the stream of filaments 36 from two or more sides of the stream of filaments 36. The filaments 36 may be created by meltblowing from a meltblow die, for example a die 48 of FIGS. 7 and 8. The mixture 54 of solid additives 40 and filaments 36 are collected on a collection device 56, such as a belt to form a fibrous structure 60. The collection device 54 may be a patterned and/or molded belt that results in the fibrous structure 60 exhibiting a surface pattern, such as a non-random, repeating pattern of microregions. The molded belt may have a three-dimensional pattern on it that gets imparted to the fibrous structure 60 during the process. For example, the patterned belt may comprise a reinforcing structure, such as a fabric upon which a polymer resin is applied in a pattern. The pattern may comprise a continuous or semi-continuous network of the polymer resin within which one or more discrete conduits are arranged.

In one example of the present invention, the fibrous structure 60 is made using a die 48 (FIGS. 7 and 8) comprising at least one and/or 2 or more and/or 3 or more rows of filament-forming holes 50 from which filaments 36 are spun. At least one row contains 2 or more and/or 3 or more and/or 10 or more filament-forming holes 50. In addition to the filament-forming holes 50, the die 48 comprises fluid-releasing holes 52, such as gas-releasing holes, in one example air-releasing holes, that provide attenuation to the filaments 36 formed from the filament-forming holes 50. One or more fluid-releasing holes 52 may be associated with a filament-forming hole 50 such that the fluid exiting the fluid-releasing hole 52 is parallel or substantially parallel (rather than angled like a knife-edge die) to an exterior surface of a filament 36 exiting the filament-forming hole 50. In one example, the fluid exiting the fluid-releasing hole 52 contacts the exterior surface of a filament 36 formed from a filament-forming hole 50 at an angle of less than 30° and/or less than 20° and/or less than 10° and/or less than 5° and/or about 0°. One or more fluid releasing holes 52 may be arranged around a filament-forming hole 50. In one example, one or more fluid-releasing holes 52 are associated with a single filament-forming hole 50 such that the fluid exiting the one or more fluid releasing holes 52 contacts the exterior surface of a single filament 36 formed from the single filament-forming hole 50. In one example, the fluid-releasing hole 52 permits a fluid, such as a gas, for example air, to contact the exterior surface of a filament 36 formed from a filament-forming hole 50 rather than contacting an inner surface of a filament 36, such as what happens when a hollow filament is formed.

In one example, the die 48 comprises a filament-forming hole 50 positioned within a fluid-releasing hole 52. The fluid-releasing hole 52 may be concentrically or substantially concentrically positioned around a filament-forming hole 50 such as is shown in FIGS. 7 and 8.

After the fibrous structure 60 has been formed on the collection device 56, the fibrous structure 60 may be subjected to post-processing operations such as embossing, thermal bonding, tuft-generating operations, moisture-imparting operations, slitting, folding, lotioning, surface treating, and combining with other fibrous structure plies operations (not shown) to form a finished fibrous structure or sanitary tissue product. One example of a surface treating operation that the fibrous structure may be subjected to is the surface application of an elastomeric binder, such as ethylene vinyl acetate (EVA), latexes, and other elastomeric binders. Such an elastomeric binder may aid in reducing the lint created from the fibrous structure during use by consumers. The elastomeric binder may be applied to one or more surfaces of the fibrous structure in a pattern, especially a non-random repeating pattern, or in a manner that covers or substantially covers the entire surface(s) of the fibrous structure.

After the fibrous structure 60 has been formed on the collection device 56, such as a patterned belt, the fibrous structure 60 may be calendered, for example, while the fibrous structure 60 is still on the collection device 56.

In another example, the fibrous structure 60 may be densified, for example with a non-random repeating pattern. In one example, the fibrous structure 60 may be carried on a porous belt and/or fabric, through a nip, for example a nip formed by a heated steel roll and a rubber roll such that the fibrous structure 60 is deflected into one or more of the pores of the porous belt resulting in localized regions of densification. Non-limiting examples of suitable porous belts and/or fabrics are commercially available from Albany International under the trade names VeloStat, ElectroTech, and MicroStat. In one example, the nip applies a pressure of at least 5 pounds per lineal inch (pli) and/or at least 10 pli and/or at least 20 pli and/or at least 50 pli and/or at least 80 pli.

The process for making fibrous structure 60 may be close coupled (where the fibrous structure is convolutedly wound into a roll prior to proceeding to a converting operation) or directly coupled (where the fibrous structure is not convolutedly wound into a roll prior to proceeding to a converting operation) with a converting operation to emboss, print, deform, surface treat, or other post-forming operation known to those in the art. For purposes of the present invention, direct coupling means that the fibrous structure 60 can proceed directly into a converting operation rather than, for example, being convolutedly wound into a roll and then unwound to proceed through a converting operation.

The process of the present invention may include preparing individual rolls of fibrous structure and/or sanitary tissue product comprising such fibrous structure(s) that are suitable for consumer use. The fibrous structure may be contacted by a bonding agent (such as an adhesive and/or dry strength agent), such that the ends of a roll of sanitary tissue product according to the present invention comprise such adhesive and/or dry strength agent.

The process may further comprise contacting an end edge of a roll of fibrous structure with a material that is chemically different from the filaments and fibers, to create bond regions that bond the fibers present at the end edge and reduce lint production during use. The material may be applied by any suitable process known in the art. Non-limiting examples of suitable processes for applying the material include non-contact applications, such as spraying, and contact applications, such as gravure roll printing, extruding, surface transferring. In addition, the application of the material may occur by transfer from contact of a log saw and/or perforating blade containing the material since, for example, the perforating operation, an edge of the fibrous structure that may produce lint upon dispensing a fibrous structure sheet from an adjacent fibrous structure sheet may be created.

The process of the present invention may include preparing individual rolls of fibrous structure and/or sanitary tissue product comprising such fibrous structure(s) that are suitable for consumer use.

NON-LIMITING EXAMPLES OF PROCESSES FOR MAKING A FIBROUS STRUCTURE OF THE PRESENT INVENTION

Example 1

A 47.5%:27.5%:20.0%:5% blend of Equistar MF650x polypropylene:Equistar 650W polypropylene:Equistar PH835 polypropylene:Polyvel S-1416 wetting agent is dry blended, to form a melt blend. The melt blend is heated to 475° F. through a melt extruder. A 15.5" wide Biax 12 row spinnerette with 192 nozzles per cross-direction inch, commercially available from Biax Fiberfilm Corporation, is utilized. 40 nozzles per cross-direction inch of the 192 nozzles have a 0.018" inside diameter while the remaining nozzles are unused for PP delivery Approximately 0.19 grams per hole per minute (ghm) of the melt blend is extruded from the open nozzles to form meltblown filaments from the melt blend. Approximately 420 SCFM of compressed air is heated such that the air exhibits a temperature of 395° F. at the spinnerette. Approximately 500 grams/minute of Koch 4825 semi-treated SSK pulp is defibrillated through a hammermill to form SSK wood pulp fibers (solid additive). Approximately 1600 SCFM of air at 80° F. and 80% relative humidity (RH) is drawn into the hammermill and carries the pulp fibers to a solid additive spreader. The solid additive spreader turns the pulp fibers and distributes the pulp fibers in the cross-direction such that the pulp fibers are injected into the meltblown filaments at a non-90° angle (a non-perpendicular fashion) for example at an angle of less than 90° as described herein through a 4"×15" cross-direction (CD) slot. A forming box surrounds the area where the meltblown filaments and pulp fibers are commingled. This forming box is designed to reduce the amount of air allowed to enter or escape from this commingling area A forming vacuum pulls air through a forming fabric thus collecting the commingled meltblown filaments and pulp fibers to form a fibrous structure. The forming vacuum is adjusted until an additional 400 SCFM of room air is drawn into the slot in the forming box. The fibrous structure formed by this process comprises about 75% by dry fibrous structure weight of pulp and about 25% by dry fibrous structure weight of meltblown filaments.

Optionally, a meltblown layer of the meltblown filaments can be added to one or both sides of the above formed fibrous structure. This addition of the meltblown layer can help reduce the lint created from the fibrous structure during use by consumers and is preferably performed prior to any thermal bonding operation of the fibrous structure. The meltblown filaments for the exterior layers can be the same or different than the meltblown filaments used on the opposite layer or in the center layer(s).

The fibrous structure may be convolutedly wound to form a roll of fibrous structure. The end edges of the roll of fibrous structure may be contacted with a material to create bond regions.

Example 2

A 20%:27.5%47.5%:5% blend of Lyondell-Basell PH835 polypropylene:Lyondell-Basell Metocene MF650W polypropylene:Exxon-Mobil PP3546 polypropylene:Polyvel S-1416 wetting agent is dry blended, to form a melt blend. The melt blend is heated to 400° F. through a melt extruder. A 15.5 inch wide Biax 12 row spinnerette with 192 nozzles per cross-direction inch, commercially available from Biax Fiberfilm Corporation, is utilized. 40 nozzles per cross-direction inch of the 192 nozzles have a 0.018 inch inside diameter while the remaining nozzles are solid, i.e. there is no opening in the nozzle. Approximately 0.19 grams per hole per minute (ghm) of the melt blend is extruded from the open nozzles to form meltblown filaments from the melt blend. Approximately 415 SCFM of compressed air is heated such that the air exhibits a temperature of 395° F. at the spinnerette. Approximately 475 g/minute of a blend of 70% Golden Isle (from Georgia Pacific) 4825 semi-treated SSK pulp and 30% *Eucalyptus* is defibrillated through a hammermill to form SSK and Euc wood pulp fibers (solid additive). Air at 85-90° F. and 85% relative humidity (RH) is drawn into the hammermill. Approximately 2400 SCFM of air carries the pulp fibers to two solid additive spreaders. The solid additive spreaders turn the pulp fibers and distribute the pulp fibers in the cross-direction such that the pulp fibers are injected into the meltblown filaments at a non-90° angle (a non-perpendicular fashion) for example at an angle of less than 90° as described herein through a 4 inch×15 inch cross-direction (CD) slot. The two solid additive spreaders are on opposite sides of the meltblown filaments facing one another. A forming box surrounds the area where the meltblown filaments and pulp fibers are commingled. This forming box is designed to reduce the amount of air allowed to enter or escape from this commingling area. A forming vacuum pulls air through a collection device, such as a patterned belt, thus collecting the commingled meltblown filaments and pulp fibers to form a fibrous structure. The fibrous structure formed by this process comprises about 75% by dry fibrous structure weight of pulp and about 25% by dry fibrous structure weight of meltblown filaments.

Optionally, a meltblown layer of the meltblown filaments can be added to one or both sides of the above formed fibrous structure. This addition of the meltblown layer can help reduce the lint created from the fibrous structure during use by consumers and is preferably performed prior to any thermal bonding operation of the fibrous structure. The meltblown filaments for the exterior layers can be the same or different than the meltblown filaments used on the opposite layer or in the center layer(s).

The fibrous structure, while on a patterned belt (e.g. Velostat 170PC 740 by Albany International), is calendered at about 40 PLI (Pounds per Linear CD inch) with a metal roll facing the fibrous structure and a rubber coated roll facing the patterned belt. The steel roll having an internal temperature of 300° F. as supplied by an oil heater.

Optionally, the fibrous structure can be adhered to a metal roll, or creping drum, using sprayed, printed, slot extruded (or other known methodology) creping adhesive solution. The fibrous structure is then creped from the creping drum and foreshortened. Alternatively or in addition to creping, the fibrous structure may be subjected to mechanical treatments such as ring rolling, gear rolling, embossing, rush transfer, tuft-generating operations, and other similar fibrous structure deformation operations.

Optionally, two or more plies of the fibrous structure can be embossed and/or laminated and/or thermally bonded together to form a multi-ply fibrous structure. The fibrous structure may be convolutedly wound to form a roll of fibrous structure. The end edges of the roll of fibrous structure may be contacted with a material to create bond regions.

Fibrous Structure

It has surprisingly been found that the fibrous structures of the present invention exhibit a pore volume distribution unlike pore volume distributions of other known fibrous structures, for example other known structured and/or textured fibrous structures. As set forth below, references to fibrous structures of the present invention are also applicable to sanitary issue products comprising one or more fibrous structures of the present invention.

The fibrous structures of the present invention have surprisingly been found to exhibit improved absorbent capacity and surface drying. In one example, the fibrous structures comprise a plurality of filaments and a plurality of solid additives, for example fibers.

The fibrous structures of the present invention comprise a plurality of filaments and optionally, a plurality of solid additives, such as fibers.

The fibrous structures of the present invention may comprise any suitable amount of filaments and any suitable amount of solid additives. For example, the fibrous structures may comprise from about 10% to about 70% and/or from about 20% to about 60% and/or from about 30% to about 50% by dry weight of the fibrous structure of filaments and from about 90% to about 30% and/or from about 80% to about 40% and/or from about 70% to about 50% by dry weight of the fibrous structure of solid additives, such as wood pulp fibers.

The filaments and solid additives of the present invention may be present in fibrous structures according to the present invention at weight ratios of filaments to solid additives of from at least about 1:1 and/or at least about 1:1.5 and/or at least about 1:2 and/or at least about 1:2.5 and/or at least about 1:3 and/or at least about 1:4 and/or at least about 1:5 and/or at least about 1:7 and/or at least about 1:10.

In one example, the solid additives, for example wood pulp fibers, may be selected from the group consisting of softwood kraft pulp fibers, hardwood pulp fibers, and mixtures thereof. Non-limiting examples of hardwood pulp fibers include fibers derived from a fiber source selected from the group consisting of: Acacia, *Eucalyptus*, Maple, Oak, Aspen, Birch, Cottonwood, Alder, Ash, Cherry, Elm, Hickory, Poplar, Gum, Walnut, Locust, Sycamore, Beech, *Catalpa, Sassafras*, Gmelina, *Albizia*, Anthocephalus, and *Magnolia*. Non-limiting examples of softwood pulp fibers include fibers derived from a fiber source selected from the group consisting of: Pine, Spruce, Fir, Tamarack, Hemlock, Cypress, and Cedar. In one example, the hardwood pulp fibers comprise tropical hardwood pulp fibers. Non-limiting examples of suitable tropical hardwood pulp fibers include *Eucalyptus* pulp fibers, Acacia pulp fibers, and mixtures thereof.

In one example, the hardwood pulp fibers exhibit a Kajaani fiber cell wall thickness of less than 5.98 μm and/or less than 5.96 μm and/or less than 5.94 μm. In another example, the hardwood pulp fibers exhibit a Kajaani fiber width of less than 14.15 μm and/or less than 14.10 μm and/or less than 14.05 μm and/or less than 14.00 μm and/or less than 13.95 μm and/or less than 13.90 μm. In another example, the hardwood pulp fibers exhibit a Kajaani millions of fibers/gram of greater than 24 millions of fibers/gram and/or greater than 20.5 millions of fibers/gram and/or greater than 21 millions of fibers/gram and/or greater than 21.5 millions of fibers/gram and/or greater than 22 millions of fibers/gram and/or greater than 22.5 millions of fibers/gram and/or greater than 23 millions of fibers/gram and/or greater than 23.5 millions of fibers/gram and/or greater than 24 millions of fibers/gram and/or greater than 24.5 millions of fibers/gram and/or greater than 25 millions of fibers/gram. In still another example, the hardwood pulp fibers exhibit a Kajaani fiber cell wall thickness of less than 6.15 μm and/or less than 6.10 μm and/or less than 6.05 μm and/or less than 6.00 μm and/or less than 5.98 μm and/or less than 5.96 μm and/or less than 5.94 μm. In even still another example, the hardwood pulp fibers exhibit a ratio of Kajaani fiber length (μm) to Kajaani fiber width (μm) of less than 45 and/or less than 43 and/or less than 41. In still yet another example, the hardwood pulp fibers exhibit a ratio of Kajaani fiber coarseness of less than 0.074 mg/m and/or less than 0.0735 mg/m In one example, the wood pulp fibers comprise softwood pulp fibers derived from the kraft process and originating from southern climates, such as Southern Softwood Kraft (SSK) pulp fibers. In another example, the wood pulp fibers comprise softwood pulp fibers derived from the kraft process and originating from northern climates, such as Northern Softwood Kraft (NSK) pulp fibers.

The wood pulp fibers present in the fibrous structure may be present at a weight ratio of softwood pulp fibers to hardwood pulp fibers of from 100:0 and/or from 90:10 and/or from 86:14 and/or from 80:20 and/or from 75:25 and/or from 70:30 and/or from 60:40 and/or about 50:50 and/or to 0:100 and/or to 10:90 and/or to 14:86 and/or to 20:80 and/or to 25:75 and/or to 30:70 and/or to 40:60. In one example, the weight ratio of softwood pulp fibers to hardwood pulp fibers is from 86:14 to 70:30.

In one example, the fibrous structures of the present invention comprise one or more trichomes. Non-limiting examples of suitable sources for obtaining trichomes, especially trichome fibers, are plants in the Labiatae (Lamiaceae) family commonly referred to as the mint family Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

In one example, the fibrous structures of the present invention exhibit a pore volume distribution such that greater than 8% and/or at least 10% and/or at least 14% and/or at least 18% and/or at least 20% and/or at least 22% and/or at least 25% and/or at least 29% and/or at least 34% and/or at least 40% and/or at least 50% of the total pore volume present in the fibrous structures exists in pores of radii of from 2.5 μm to 50 μm as measured by the Pore Volume Distribution Test Method described herein.

In another example, the fibrous structures of the present invention exhibit a sled surface drying time of less than 50 seconds and/or less than 45 seconds and/or less than 40 seconds and/or less than 35 seconds and/or 30 seconds and/or 25 seconds and/or 20 seconds as measured by the Sled Surface Drying Test Method described herein.

In yet another example, the fibrous structures of the present invention exhibit a pore volume distribution such that at least 2% and/or at least 9% and/or at least 10% and/or at least 12% and/or at least 17% and/or at least 18% and/or at least 28% and/or at least 32% and/or at least 43% of the total pore volume present in the fibrous structure exists in pores of radii of from 91 μm to 140 μm as measured by the Pore Volume Distribution Test Method described herein.

In even yet another example, the fibrous structures of the present invention exhibit a pore volume distribution such that at least 2% and/or at least 9% and/or at least 10% and/or at least 12% and/or at least 17% and/or at least 18% and/or at least 20% and/or at least 28% and/or at least 32% and/or at least 43% of the total pore volume present in the fibrous structure exists in pores of radii of from 91 μm to 120 μm and/or exhibit a pore volume distribution such that less than 50% and/or less than 45% and/or less than 40% and/or less than 38% and/or less than 35% and/or less than 30% of the total pore volume present in the fibrous structure exists in pores of radii of from 101 μm to 200 μm as measured by the Pore Volume Distribution Test Method described herein. In one example, the fibrous structures of the present invention exhibit a pore volume distribution such that at least 20% and/or at least 28% and/or at least 32% and/or at least 43% of the total pore volume present in the fibrous structure exists in pores of radii of from 91 μm to 120 μm and exhibit a pore volume distribution such that less than 40% and/or less than 38% and/or less than 35% and/or less than 30% of the total pore volume present in the fibrous structure exists in pores of radii of from 101 μm to 200 μm as measured by the Pore Volume Distribution Test Method described herein.

In even yet another example, the fibrous structures of the present invention exhibit a pore volume distribution such that at least 2% and/or at least 9% and/or at least 10% and/or at least 12% and/or at least 17% and/or at least 18% and/or at least 20% and/or at least 28% and/or at least 32% and/or at least 43% of the total pore volume present in the fibrous structure exists in pores of radii of from 91 μm to 140 μm and/or exhibit a pore volume distribution such that less than 50% and/or less than 45% and/or less than 40% and/or less than 38% and/or less than 35% and/or less than 30% of the total pore volume present in the fibrous structure exists in pores of radii of from 101 μm to 200 μm and/or exhibit a pore volume distribution such that less than 50% and/or less than 45% and/or less than 40% and/or less than 38% and/or less than 35% and/or less than 30% of the total pore volume present in the fibrous structure exists in pores of radii of from 121 μm to 200 μm as measured by the Pore Volume Distribution Test Method described herein. In another example, the fibrous structures of the present invention exhibit a pore volume distribution such that at least 43% of the total pore volume present in the fibrous structure exists in pores of radii of from 91 μm to 140 μm and exhibit a pore volume distribution less than 40% and/or less than 38% and/or less than 35% and/or less than 30% of the total pore volume present in the fibrous structure exists in pores of radii of from 101 μm to 200 μm and exhibit a pore volume distribution less than 40% and/or less than 38% and/or less than 35% and/or less than 30% of the total pore volume present in the fibrous structure exists in pores of radii of from 121 μm to 200 μm as measured by the Pore Volume Distribution Test Method described herein.

In even yet another example, the fibrous structures of the present invention exhibit a pore volume distribution such that at least 2% and/or at least 9% and/or at least 10% and/or at least 12% and/or at least 17% and/or at least 18% and/or at least 20% and/or at least 28% and/or at least 32% and/or at least 43% of the total pore volume present in the fibrous structure exists in pores of radii of from 91 μm to 140 μm and/or exhibit a pore volume distribution such that less than 50% and/or less than 45% and/or less than 40% and/or less than 38% and/or less than 35% and/or less than 30% of the total pore volume present in the fibrous structure exists in pores of radii of from 101 μm to 200 μm as measured by the Pore Volume Distribution Test Method described herein. In another example, the fibrous structures of the present invention exhibit a pore volume distribution such that at least 43% of the total pore volume present in the fibrous structure exists in pores of radii of from 91 μm to 140 μm and exhibit a pore volume distribution less than 40% and/or less than 38% and/or less than 35% and/or less than 30% of the total pore volume present in the fibrous structure exists in pores of radii of from 101 μm to 200 μm as measured by the Pore Volume Distribution Test Method described herein.

In one example, the fibrous structure of the present invention exhibits at least a bi-modal pore volume distribution (i.e., the pore volume distribution exhibits at least two modes). A fibrous structure according to the present invention exhibiting a bi-modal pore volume distribution provides beneficial absorbent capacity and absorbent rate as a result of the larger radii pores and beneficial surface drying as a result of the smaller radii pores.

In still another example, the fibrous structures of the present invention exhibit a VFS of greater than 5 g/g and/or greater than 6 g/g and/or greater than 8 g/g and/or greater than 10 g/g and/or greater than 11 g/g as measured by the VFS Test Method described herein.

In still another example, the fibrous structures of the present invention exhibit a HFS of greater than 5 g/g and/or greater than 6 g/g and/or greater than 8 g/g and/or greater than 10 g/g and/or greater than 11 g/g as measured by the HFS Test Method described herein.

In one example, the fibrous structure of the present invention, alone or as a ply of fibrous structure in a multi-ply fibrous structure, comprises at least one surface (interior or exterior surface in the case of a ply within a multi-ply fibrous structure) that consists of a layer of filaments.

In still another example, the fibrous structure of the present invention, alone or as a ply of fibrous structure in a multi-ply fibrous structure, comprises a scrim material.

In another example, the fibrous structure of the present invention, alone or as a ply of fibrous structure in a multi-ply fibrous structure, comprises a creped fibrous structure. The creped fibrous structure may comprise a fabric creped fibrous structure, a belt creped fibrous structure, and/or a cylinder creped, such as a cylindrical dryer creped fibrous structure. In one example, the fibrous structure may comprise undulations and/or a surface comprising undulations.

In yet another example, the fibrous structure of the present invention, alone or as a ply of fibrous structure in a multi-ply fibrous structure, comprises an uncreped fibrous structure.

In still another example, the fibrous structure of the present invention, alone or as a ply of fibrous structure in a multi-ply fibrous structure, comprises a foreshortened fibrous structure. The fibrous structures of the present invention and/or any sanitary tissue products comprising such fibrous structures may be subjected to any post-processing operations such as embossing operations, printing operations, tuft-generating operations, thermal bonding operations, ultrasonic bonding operations, perforating operations, surface treatment operations such as application of lotions, silicones and/or other materials and mixtures thereof.

Non-limiting examples of suitable polypropylenes for making the filaments of the present invention are commercially available from Lyondell-Basell and Exxon-Mobil.

Any hydrophobic or non-hydrophilic materials within the fibrous structure, such as polypropylene filaments, may be surface treated and/or melt treated with a hydrophilic modifier. Non-limiting examples of surface treating hydrophilic modifiers include surfactants, such as Triton X-100. Non-limiting examples of melt treating hydrophilic modifiers that are added to the melt, such as the polypropylene melt, prior to spinning filaments, include hydrophilic modifying melt additives such as VW351 and/or S-1416 commercially available from Polyvel, Inc. and Irgasurf commercially available from Ciba. The hydrophilic modifier may be associated with the hydrophobic or non-hydrophilic material at any suitable level known in the art. In one example, the hydrophilic modifier is associated with the hydrophobic or non-hydrophilic material at a level of less than about 20% and/or less than about 15% and/or less than about 10% and/or less than about 5% and/or less than about 3% to about 0% by dry weight of the hydrophobic or non-hydrophilic material.

The fibrous structures of the present invention may include optional additives, each, when present, at individual levels of from about 0% and/or from about 0.01% and/or from about 0.1% and/or from about 1% and/or from about 2% to about 95% and/or to about 80% and/or to about 50% and/or to about 30% and/or to about 20% by dry weight of the fibrous structure. Non-limiting examples of optional additives include permanent wet strength agents, temporary wet strength agents, dry strength agents such as carboxymethylcellulose and/or starch, softening agents, lint reducing agents, opacity increasing agents, wetting agents, odor absorbing agents, perfumes, temperature indicating agents, color agents, dyes, osmotic materials, microbial growth detection agents, antibacterial agents and mixtures thereof.

The fibrous structure of the present invention may itself be a sanitary tissue product. It may be convolutedly wound about a core to form a roll. It may be combined with one or more other fibrous structures as a ply to form a multi-ply sanitary tissue product. In one example, a co-formed fibrous structure of the present invention may be convolutedly wound about a core to form a roll of co-formed sanitary tissue product. The rolls of sanitary tissue products may also be coreless.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 12 hours prior to the test. All plastic and paper board packaging articles of manufacture, if any, must be carefully removed from the samples prior to testing. The samples tested are "usable units." "Usable units" as used herein means sheets, flats from roll stock, pre-converted flats, and/or single or multi-ply products. Except where noted all tests are conducted in such conditioned room, all tests are conducted under the same environmental conditions and in such conditioned room. Discard any damaged product. Do not test samples that have defects such as wrinkles, tears, holes, and like. All instruments are calibrated according to manufacturer's specifications. Samples conditioned as described herein are considered dry samples (such as "dry fibrous structures") for purposes of this invention.

Pore Volume Distribution Test Method

Pore Volume Distribution measurements are made on a TRI/Autoporosimeter (TRI/Princeton Inc. of Princeton, N.J.). The TRI/Autoporosimeter is an automated computer-controlled instrument for measuring pore volume distributions in porous materials (e.g., the volumes of different size pores within the range from 1 to 1000 μm effective pore radii). Complimentary Automated Instrument Software, Release 2000.1, and Data Treatment Software, Release 2000.1 is used to capture, analyze and output the data. More information on the TRI/Autoporosimeter, its operation and data treatments can be found in The Journal of Colloid and Interface Science 162 (1994), pgs 163-170, incorporated here by reference.

As used in this application, determining Pore Volume Distribution involves recording the increment of liquid that enters a porous material as the surrounding air pressure changes. A sample in the test chamber is exposed to precisely controlled changes in air pressure. The size (radius) of the largest pore able to hold liquid is a function of the air pressure. As the air pressure increases (decreases), different size pore groups drain (absorb) liquid. The pore volume of each group is equal to this amount of liquid, as measured by the instrument at the corresponding pressure. The effective radius of a pore is related to the pressure differential by the following relationship.

$$\text{Pressure differential}=[(2)\gamma \cos \Theta]/\text{effective radius}$$

where $\gamma$=liquid surface tension, and $\Theta$=contact angle.

Typically pores are thought of in terms such as voids, holes or conduits in a porous material. It is important to note that this method uses the above equation to calculate effective pore radii based on the constants and equipment controlled pressures. The above equation assumes uniform cylindrical pores. Usually, the pores in natural and manufactured porous materials are not perfectly cylindrical, nor all uniform. Therefore, the effective radii reported here may not equate exactly to measurements of void dimensions obtained by other methods such as microscopy. However, these measurements do provide an accepted means to characterize relative differences in void structure between materials.

The equipment operates by changing the test chamber air pressure in user-specified increments, either by decreasing pressure (increasing pore size) to absorb liquid, or increasing pressure (decreasing pore size) to drain liquid. The liquid volume absorbed at each pressure increment is the cumulative volume for the group of all pores between the preceding pressure setting and the current setting.

In this application of the TRI/Autoporosimeter, the liquid is a 0.2 weight % solution of octylphenoxy polyethoxy ethanol (Triton X-100 from Union Carbide Chemical and Plastics Co. of Danbury, Conn.) in distilled water. The instrument calculation constants are as follows: $\rho$(density)= 1 g/cm$^3$; $\gamma$ (surface tension)=31 dynes/cm; cos $\Theta$=1. A 1.2 μm Millipore Glass Filter (Millipore Corporation of Bedford, Mass.; Catalog # GSWP09025) is employed on the test chamber's porous plate. A plexiglass plate weighing about 24 g (supplied with the instrument) is placed on the sample to ensure the sample rests flat on the Millipore Filter. No additional weight is placed on the sample.

The remaining user specified inputs are described below. The sequence of pore sizes (pressures) for this application is as follows (effective pore radius in μm): 1, 2.5, 5, 10, 15, 20, 30, 40, 50, 60, 70, 80, 90, 100, 120, 140, 160, 180, 200, 225, 250, 275, 300, 350, 400, 500, 600, 800, 1000. This sequence starts with the sample dry, saturates it as the pore settings increase (typically referred to with respect to the procedure and instrument as the $1^{st}$ absorption).

In addition to the test materials, a blank condition (no sample between plexiglass plate and Millipore Filter) is run to account for any surface and/or edge effects within the chamber. Any pore volume measured for this blank run is subtracted from the applicable pore grouping of the test sample. This data treatment can be accomplished manually or with the available TRI/Autoporosimeter Data Treatment Software, Release 2000.1.

Percent (%) Total Pore Volume is a percentage calculated by taking the volume of fluid in the specific pore radii range divided by the Total Pore Volume. The TRI/Autoporosimeter outputs the volume of fluid within a range of pore radii. The first data obtained is for the "2.5 micron" pore radii which includes fluid absorbed between the pore sizes of 1 to 2.5 micron radius. The next data obtained is for "5 micron" pore radii, which includes fluid absorbed between the 2.5 micron and 5 micron radii, and so on. Following this logic, to obtain the volume held within the range of 91-140 micron radii, one would sum the volumes obtained in the range titled "100 micron", "110 micron", "120 micron", "130 micron", and finally the "140 micron" pore radii ranges. For example, % Total Pore Volume 91-140 micron pore radii=(volume of fluid between 91-140 micron pore radii)/Total Pore Volume.

Basis Weight Test Method

Basis weight of a fibrous structure sample is measured by selecting twelve (12) individual fibrous structure samples and making two stacks of six individual samples each. If the individual samples are connected to one another vie perforation lines, the perforation lines must be aligned on the same side when stacking the individual samples. A precision cutter is used to cut each stack into exactly 3.5 in.×3.5 in. squares. The two stacks of cut squares are combined to make a basis weight pad of twelve squares thick. The basis weight pad is then weighed on a top loading balance with a minimum resolution of 0.01 g. The top loading balance must be protected from air drafts and other disturbances using a draft shield. Weights are recorded when the readings on the top loading balance become constant. The Basis Weight is calculated as follows:

$$\text{Basis Weight } (\text{lbs}/3000\ \text{ft}^2) = \frac{\text{Weight of basis weight pad (g)} \times 3000\ \text{ft}^2}{453.6\ \text{g/lbs} \times 12\ \text{samples} \times \left[12.25\ \text{in}^2 \left(\begin{matrix}\text{Area of basis}\\ \text{weight pad}\end{matrix}\right) \Big/ 144\ \text{in}^2\right]}$$

$$\text{Basis Weight } (\text{g/m}^2) = \frac{\text{Weight of basis weight pad (g)} \times 10{,}000\ \text{cm}^2/\text{m}^2}{79.0321\ \text{cm}^2\ \text{(Area of basis weight pad)} \times 12\ \text{samples}}$$

The level of filaments present in a fibrous structure having an initial basis weight can be determined by measuring the filament basis weight of a fibrous structure by using the Basis Weight Test Method after separating all non-filament materials from a fibrous structure. Different approaches may be used to achieve this separation. For example, non-filament material may be dissolved in an appropriate dissolution agent, such as sulfuric acid or Cadoxen, leaving the filaments intact with their mass essentially unchanged. The filaments are then weighed. The weight percentage of filaments present in the fibrous structure is then determined by the equation:

% wt. Filaments=100*(Filament Mass/Initial Basis Weight of Fibrous Structure)

The % wt. Solid Additives present in the fibrous structure can then be determined by subtracting the % wt. Filaments from 100% to arrive at the % wt. Solid Additives.

MD Basis Weight Test Method

The machine direction (MD) Basis Weight of a fibrous structure sample is measured by using a precision cutter to cut thirty-five single ply 100 mm×50 mm rectangle samples. Each sample should be weighed individually. Each 100 mm×50 mm rectangle sample are to be oriented so that the 100 mm axis is in the cross-direction (CD), from the same CD position, and be located in the MD as close as possible to each other, so that the intent of capturing the immediate MD basis weight variation at any CD location is achieved. The weight of the rectangle samples are then weighed on a top loading balance with a minimum resolution of 0.01 g. The top loading balance must be protected from air drafts and other disturbances using a draft shield. The weights of the rectangle samples are recorded when the readings on the top loading balance become constant. The Basis Weight (BW) of the fibrous structure is calculated as follows:

$$BW\ (\text{g/m}^2) = \frac{\text{Weight of basis weight pad (g)} \times 10{,}000\ \text{cm}^2/\text{m}^2}{50\ \text{cm}^2\ \text{(Area of basis weight sample)}}$$

The MD Basis Weight Coefficient of Variation ("MD Basis Weight Variation" or "MD Basis Weight COV") is defined as the standard deviation of basis weights divided by the average basis weights as measured according to the MD Basis Weight Test Method described above for thirty-five 50 mm (MD)×100 mm (CD) fibrous structure samples as measured according to the MD Basis Weight Test Method described above.

Horizontal Full Sheet (HFS) Test Method

The Horizontal Full Sheet (HFS) test method determines the amount of distilled water absorbed and retained by a fibrous structure of the present invention. This method is performed by first weighing a sample of the fibrous structure to be tested (referred to herein as the "dry weight of the sample"), then thoroughly wetting the sample, draining the wetted sample in a horizontal position and then reweighing (referred to herein as "wet weight of the sample"). The absorptive capacity of the sample is then computed as the amount of water retained in units of grams of water absorbed by the sample. When evaluating different fibrous structure samples, the same size of fibrous structure is used for all samples tested.

The apparatus for determining the HFS capacity of fibrous structures comprises the following:

1) An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sample tested (i.e.; a fibrous structure sample of about 11 in. (27.9 cm) by 11 in. (27.9 cm)). The balance pan can be made out of a variety of materials. Plexiglass is a common material used.

Figure 9A:
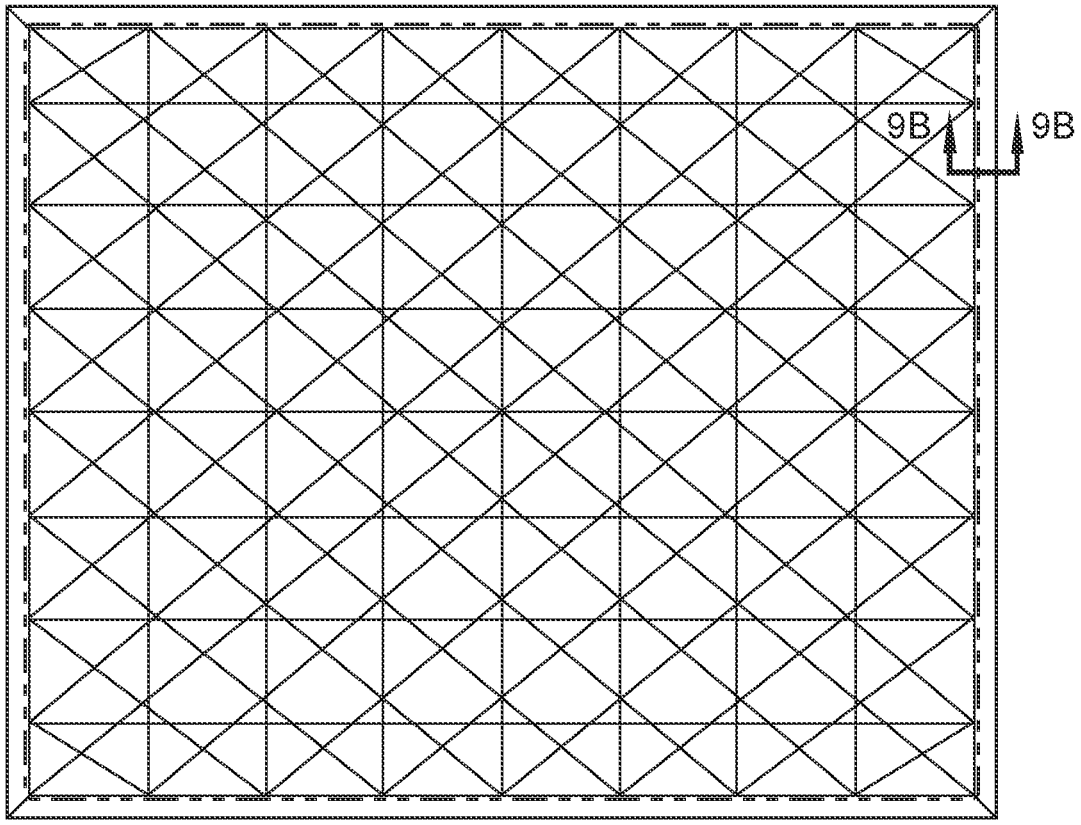
FIG. 9A is a diagram of a support rack utilized in the HFS Test Method described herein.
Figure 9B:
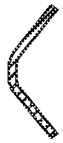
FIG. 9B is a cross-sectional view of FIG. 9A.
Figure 10A:
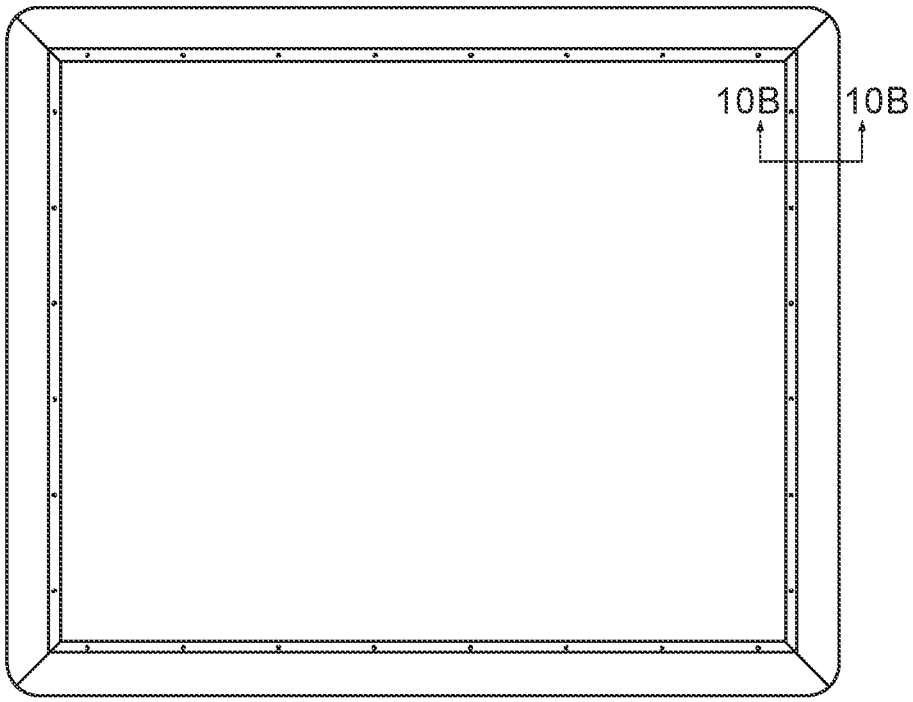
FIG. 10A is a diagram of a support rack cover utilized in the VFS Test Method described herein.
Figure 10B:
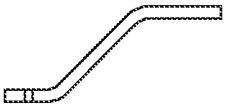
FIG. 10B is a cross-sectional view of FIG. 10A.

2) A sample support rack (FIGS. 9A and 9B) and sample support rack cover (FIGS. 10A and 10B) is also required. Both the rack and cover are comprised of a lightweight metal frame, strung with 0.012 in. (0.305 cm) diameter monofilament so as to form a grid as shown in FIG. 9A. The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

Eight samples of a fibrous structure to be tested are carefully weighed on the balance to the nearest 0.01 grams. The dry weight of each sample is reported to the nearest 0.01 grams. The empty sample support rack is placed on the balance with the special balance pan described above. The balance is then zeroed (tared). One sample is carefully placed on the sample support rack. The support rack cover is placed on top of the support rack. The sample (now sandwiched between the rack and cover) is submerged in the water reservoir. After the sample is submerged for 60 seconds, the sample support rack and cover are gently raised out of the reservoir.

The sample, support rack and cover are allowed to drain horizontally for 120±5 seconds, taking care not to excessively shake or vibrate the sample. While the sample is draining, the rack cover is carefully removed and all excess water is wiped from the support rack. The wet sample and the support rack are weighed on the previously tared balance. The weight is recorded to the nearest 0.01 g. This is the wet weight of the sample.

The gram per fibrous structure sample absorptive capacity of the sample is defined as (wet weight of the sample−dry weight of the sample). The horizontal absorbent capacity (HAC) is defined as: absorbent capacity=(wet weight of the sample−dry weight of the sample)/(dry weight of the sample) and has a unit of gram/gram.

Vertical Full Sheet (VFS) Test Method

The Vertical Full Sheet (VFS) test method determines the amount of distilled water absorbed and retained by a fibrous structure of the present invention. This method is performed by first weighing a sample of the fibrous structure to be tested (referred to herein as the "dry weight of the sample"), then thoroughly wetting the sample, draining the wetted sample in a vertical position and then reweighing (referred to herein as "wet weight of the sample"). The absorptive capacity of the sample is then computed as the amount of water retained in units of grams of water absorbed by the sample. When evaluating different fibrous structure samples, the same size of fibrous structure is used for all samples tested.

The apparatus for determining the VFS capacity of fibrous structures comprises the following:

1) An electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sample tested (i.e.; a fibrous structure sample of about 11 in. by 11 in.). The balance pan can be made out of a variety of materials. Plexiglass is a common material used.

2) A sample support rack (FIGS. 9A and 9B) and sample support rack cover (FIGS. 10A and 10B) is also required. Both the rack and cover are comprised of a lightweight metal frame, strung with 0.012 in. diameter monofilament so as to form a grid as shown in FIG. 9A. The size of the support rack and cover is such that the sample size can be conveniently placed between the two.

The VFS test is performed in an environment maintained at 23±1° C. and 50±2% relative humidity. A water reservoir or tub is filled with distilled water at 23±1° C. to a depth of 3 inches.

Eight 7.5 inch×7.5 inch to 11 inch×11 inch samples of a fibrous structure to be tested are carefully weighed on the balance to the nearest 0.01 grams. The dry weight of each sample is reported to the nearest 0.01 grams. The empty sample support rack is placed on the balance with the special balance pan described above. The balance is then zeroed (tared). One sample is carefully placed on the sample support rack. The support rack cover is placed on top of the support rack. The sample (now sandwiched between the rack and cover) is submerged in the water reservoir. After the sample is submerged for 60 seconds, the sample support rack and cover are gently raised out of the reservoir.

The sample, support rack and cover are allowed to drain vertically (at angle greater than 60° but less than 90° from horizontal) for 60±5 seconds, taking care not to excessively shake or vibrate the sample. While the sample is draining, the rack cover is removed and excess water is wiped from the support rack. The wet sample and the support rack are weighed on the previously tared balance. The weight is recorded to the nearest 0.01 g. This is the wet weight of the sample.

The procedure is repeated for with another sample of the fibrous structure, however, the sample is positioned on the support rack such that the sample is rotated 90° in plane compared to the position of the first sample on the support rack.

The gram per fibrous structure sample absorptive capacity of the sample is defined as (wet weight of the sample−dry weight of the sample). The calculated VFS is the average of the absorptive capacities of the two samples of the fibrous structure.

Sled Surface Drying Test Method

Figure 1:
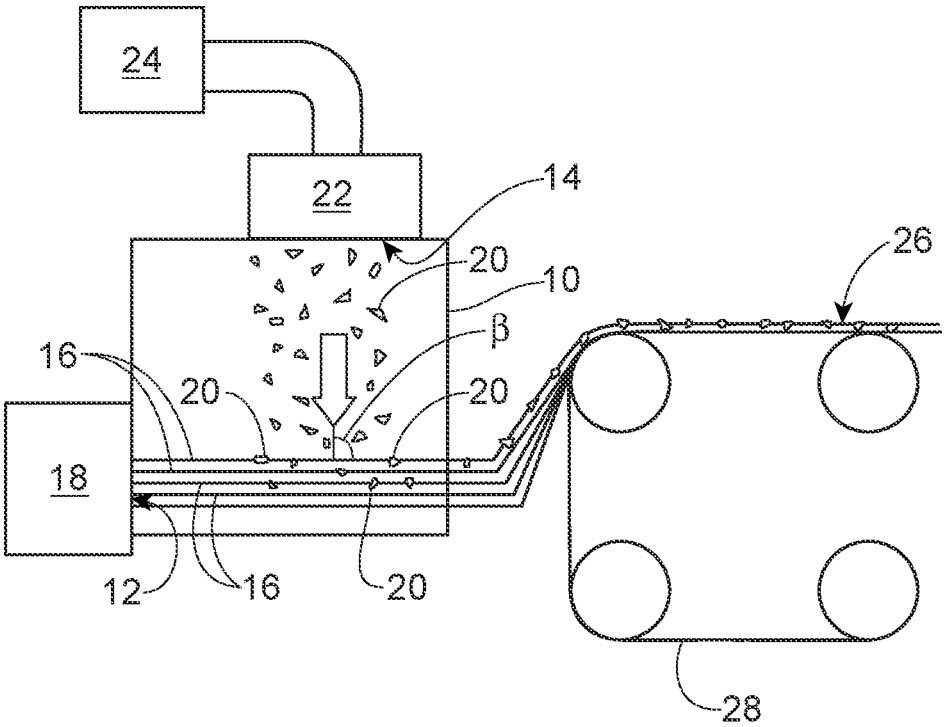
Fig. 1 PRIOR ART
FIG. 1 is an example of a prior art coforming process that utilizes a forming box.
Figure 2:
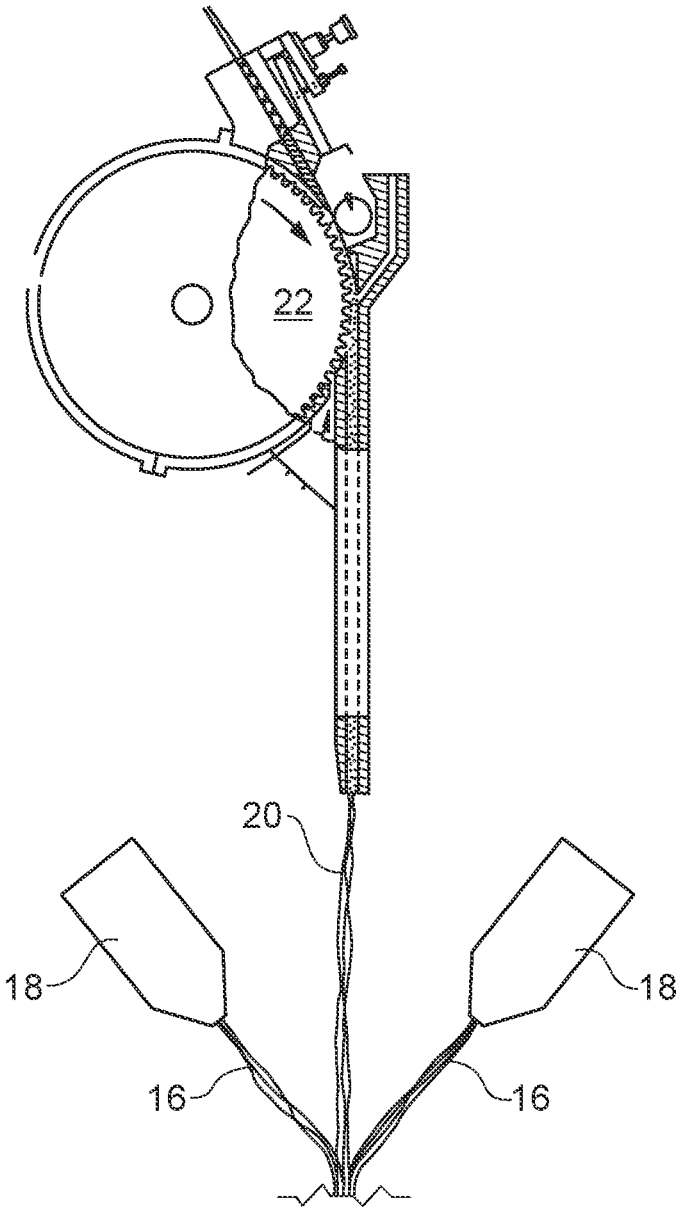
Fig. 2 PRIOR ART
FIG. 2 is an example of a prior art coforming process that does not utilize a forming box.
Figure 3:
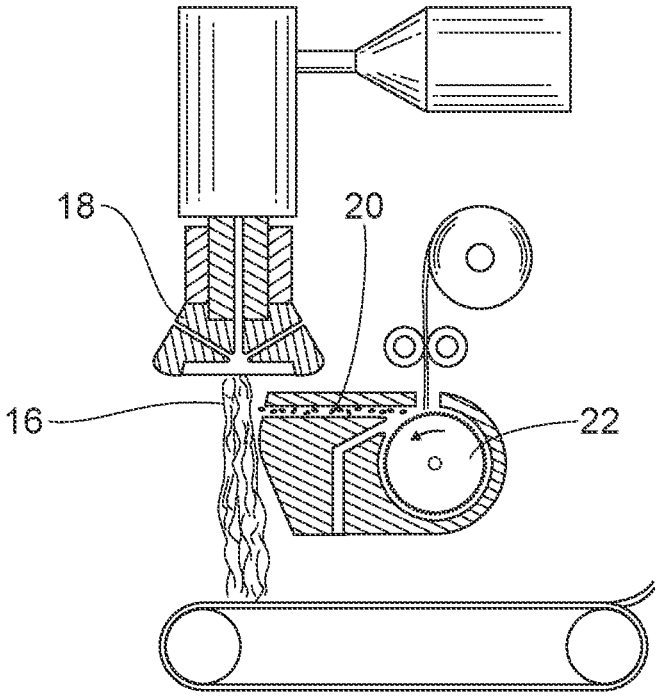
Fig. 3 PRIOR ART
FIG. 3 is an another example of a prior art coforming process that does not utilize a forming box.

The sled surface drying test is performed using constant rate of extension tensile tester with computer interface (a suitable instrument is the MTS Alliance using Testworks 4 Software, as available from MTS Systems Corp., Eden Prairie, Minn.) using a load cell for which the forces measured are within 10% to 90% of the limit of the cell. The instrument is fitted with a coefficient of friction fixture and sled as depicted in ASTM D 1894-01 FIG. 1*c*. (a suitable fixture is the Coefficient of Friction Fixture and Sled available as #769-3000 from Thwing-Albert, West Berlin, N.J.). The movable (upper) pneumatic jaw is fitted with rubber faced grips, suitable to securely clamp the sled's lead wire. The target surface is a black Formica® brand laminate #909-58 which has a contact angle (water) of 66±5 degrees. All testing is performed in a conditioned room maintained at 23° C.±2 C.° and 50±2% relative humidity. The test area is substantially free from air drafts from doors, ventilation systems, or lab traffic. The target surface at the observation zone is illuminated at 7.5 lumens±0.2 lumens.

Figure 11:
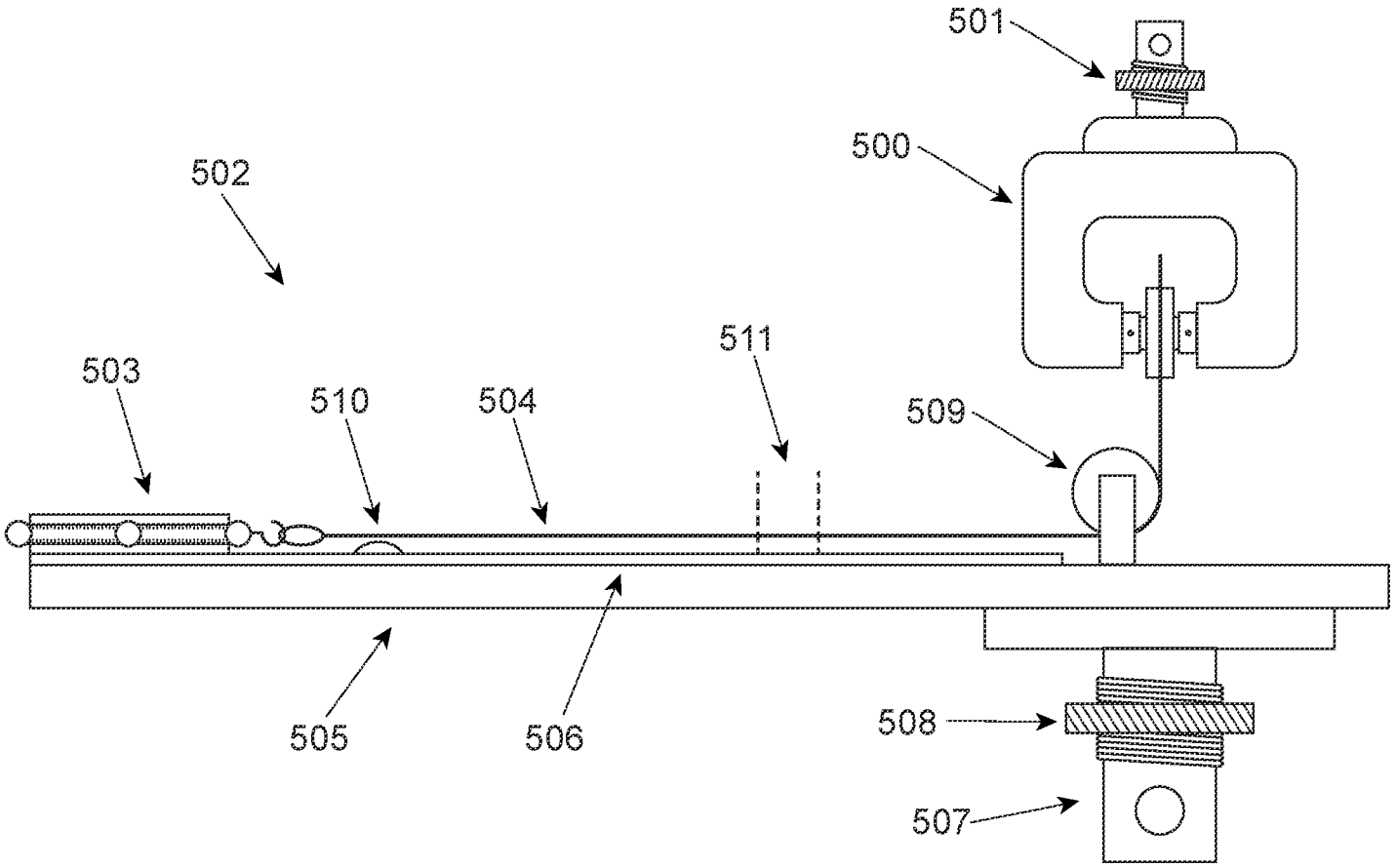
FIG. 11 is a schematic representation of an apparatus used in the Sled Surface Drying Test Method.

Referring to FIG. 11, the lower fixture 502, consist of a stage 505, 40 in long by 6 in wide by 0.25 in thick, mounted via a shaft 507 designed to fit the lower mount of tensile tester. A locking collar 508 is used to stabilize the platform and maintain horizontal alignment. The stage is covered with the Formica target 506 which is 38 in long by 6 in wide by 0.128 in thick. A pulley 509 is attached to the stage 505 which directs the wire lead 504 from the sled 503 into the grip faces of the upper fixture 500. Time is measured using a lab timer capable of measuring to the nearest 0.1 sec. and certified traceable to NIST.

Condition the sample at 23° C.±2 C.° and 50±2% relative humidity for 2 hours prior to testing. Die cut a specimen 127 mm±1 mm long in the machine direction and 64 mm±1 mm wide in the cross direction. Load the specimen onto the sled 503 by feeding the specimen through the spring-loaded bar grips. Once clamped, the specimen is without slack and completely covers the bottom surface of the sled 503. The acceptable weight of the sled plus sample is 200 g±2 g.

Set the position of the tensile tester crosshead such that the centers of the grip faces are approximately 1.5 in above the top of the pulley. Place the distal end of the sled 503 flush with the distal edge of the target surface 506 as shown in FIG. 11. The sled should be centered along the longitudinal center line of the target. Attach the lead wire 504 first to the sled 503 Feed the other end of the wire lead 504 around the pulley 509 and then between the grip faces of the upper fixture. Zero the load cell. Gently pull the lead wire 504 until a force of 20±5 gram force is read on the load cell. Close the grip faces. Program the tensile tester to move the crosshead for 36 in at a rate of 400 in/min.

Clean the Formica target with 2-propanol and allow the surface to dry. With a calibrated pipette, deposit 0.5 mL of distilled water onto the target centered along the longitudinal axis of the target and 8 in from the distal edge of the target. The diameter of the water should not exceed 0.75 inch (for convenience a circle 0.75 inch in diameter can be marked at the site). Zero the crosshead and the timer. Simultaneously start the timer and begin the test.

After the sled movement has ceased, observe the evaporation of the liquid streak. The observer should monitor a 1 in wide observation zone 511, located between 28 to 29 inches from the distal edge of the target 506, while at an observation angle of approximately 45 degrees from the horizontal plane of the platform 505. The timer is stopped when all signs of the water have disappeared. Record the Sled Surface Drying Time to the nearest 0.1 sec.

Testing is repeated for a total of 20 replicates for each sample. Clean the surface every five specimen or when a new sample is to be tested. The data set can be evaluated using the Grub's T test (Tcrit<90%) for outliers, but no more than 3 replicates can be discarded. If more than 3 outliers exist, a second set of 20 replicates should be tested. Average the replicate samples and report the Sled Surface Drying Time to the nearest 0.1 sec.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A coform box defined by a housing comprising one or more filament inlets and one or more additive inlets wherein at least one of the one or more additive inlets is connected to at least one of the one or more filament inlets, wherein the at least one of the one or more filament inlets is connected to one or more meltblow dies and wherein at least one of the one or more meltblow dies is connected to the housing that defines the coform box, wherein the housing that defines the coform box exhibits a downwardly flaring section from the one or more additive inlets to an exit of the coform box.

2. The coform box according to claim 1 wherein at least one of the one or more meltblow dies is a multi-row capillary meltblow die.

3. The coform box according to claim 1 wherein the coform box is geometrically symmetric with respect to the coform box's cross machine-direction axis.

4. The coform box according to claim 1 wherein the coform box exhibits symmetric momentum with respect to the coform box's cross machine-direction axis.

5. The coform box according to claim 1 wherein the coform box exhibits symmetric horizontal momentum with respect to the coform box's cross machine-direction axis.

6. The coform box according to claim 1 wherein the at least one of the one or more filament inlets is at an angle of less than 85° to the at least one of the one or more additive inlets.

7. The coform box according to claim 1 wherein the at least one of the one or more filament inlets is positioned between the at least one of the one or more additive inlets and at least one other of the one or more additive inlets.

8. The coform box according to claim 1 wherein the coform box exhibits a JAR of greater than 0.5 during operation.

9. The coform box according to claim 1 wherein the coform box exhibits a JAR of less than 15 during operation.

10. The coform box according to claim 1 wherein the one or more additive inlets are in fluid communication with an additive source.

11. The coform box according to claim 1 wherein at least two of the one or more additive inlets are independently controllable during operation.

12. The coform box according to claim 11 wherein the at least two of the one or more additive inlets are independently controllable with respect to concentration, type of additive, composition, aspect ratio of additive, and mixtures thereof.

13. The coform box according to claim 1 wherein at least two of the one or more filament inlets are independently controllable during operation.

14. The coform box according to claim 13 wherein the at least two of the one or more filament inlets are independently controllable with respect to concentration, type of polymer, composition, aspect ratio of additive, and mixtures thereof.

15. The coform box according to claim 1 wherein at least one of the one or more filament inlets or at least one of the one or more additive inlets is independently controllable.

* * * * *